US006688730B2

(12) United States Patent
Asaki et al.

(10) Patent No.: US 6,688,730 B2
(45) Date of Patent: Feb. 10, 2004

(54) INK JET RECORDING SYSTEM AND METHOD OF PRESERVING RECORDING HEAD

(75) Inventors: Noriyasu Asaki, Kanagawa (JP); Hiroyuki Kigami, Kanagawa (JP); Teruo Ozaki, Kanagawa (JP); Hiroki Tajima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/942,585

(22) Filed: Aug. 31, 2001

(65) Prior Publication Data

US 2002/0070995 A1 Jun. 13, 2002

(30) Foreign Application Priority Data

Sep. 4, 2000 (JP) ..... 2000-267814

(51) Int. Cl.[7] ..... B41J 2/14; B41J 2/175

(52) U.S. Cl. ..... 347/64; 347/62; 347/63; 347/96; 347/100

(58) Field of Search ..... 347/56, 66, 67, 347/61, 62, 63, 64, 65, 96, 100, 22, 92

(56) References Cited

U.S. PATENT DOCUMENTS

| | | | | |
|---|---|---|---|---|
| 4,429,321 A | 1/1984 | Matsumoto | ..... | 346/140 |
| 5,980,021 A | 11/1999 | Nagoshi et al. | ..... | 347/49 |
| 6,062,390 A | 5/2000 | Nakamura | ..... | 206/576 |

FOREIGN PATENT DOCUMENTS

| | | | | |
|---|---|---|---|---|
| EP | 547874 | * 6/1993 | ..... | B41J/2/175 |
| EP | 594124 | 4/1994 | | |
| EP | 819529 | 1/1998 | | |
| EP | 953614 | 11/1999 | | |
| EP | 956961 | 11/1999 | | |
| JP | 4-255357 | * 9/1992 | ..... | 347/64 |
| JP | 3021149 | 1/2000 | | |
| JP | 2000-108493 | 4/2000 | | |
| JP | 2000-127442 | 5/2000 | | |

* cited by examiner

*Primary Examiner*—Huan Tran
(74) *Attorney, Agent, or Firm*—Fitzpatrick, Cella, Harper & Scinto

(57) ABSTRACT

A method of preserving a recording head which includes an ink flow path by which the ink is supplied and a discharge port in communication with the ink flow path to discharge the ink supplied into the ink flow path; is connected to an ink tank in the recording apparatus in such a way to be removably attached to or detached from the ink tank, to allow the ink to be discharged from the discharge port; and uses a reactive ink as the recording ink containing a colorant and reactive component reactive with another ink, comprises a step of examining discharging conditions of the recording head using an ink for examination of a composition free of the reactive component, which is supplied into the ink flow path, and a step of step of preserving the recording head for preservation by replacing the ink for examination remaining in the ink flow path in the recording head by an ink for preservation containing neither the colorant nor reactive component, after the step of examining discharging conditions is over.

32 Claims, 9 Drawing Sheets

INK JET RECORDING SYSTEM AND METHOD OF PRESERVING RECORDING HEAD

BACKGROUND OF THE INVENTION

1. Field of the Invention

The present invention relates to a method of preserving a recording head which uses a reactive ink, ink jet system including a set of recording head and ink tank as the form of preserving the recording head, and ink set including a recording ink and ink for preservation, applicable to the method of preservation.

2. Related Background Art

Japanese Patent 3,021,149 discloses a cartridge including a recording head and ink tank section from which the ink is supplied into the recording head, structured in such a way that the recording head and ink tank section can be removably attached to or detached from the cartridge, are connected to work in communication with each other while the cartridge is in service, and independently exchangeable after the recording is completed, to propose a method of improving preservability of the recording head while it is stored for extended periods, e.g., for delivery periods, removing limitations in delivery of the recording head, and improving freedom of handling by filling the recording head with a liquid for preservation (ink for preservation) which compositionally differs from the recording ink in that the colorant component is removed partly in a given quantity or totally from the recording ink before the initial use of the recording head.

SUMMARY OF THE INVENTION

However, a large quantity of the ink for preservation is needed, for the ink to completely replace a reactive ink by which the as-produced recording head is tested for the printed letters using an ink set including a reactive ink, then the recording head is filled with the ink for preservation making the complete replacement unpractical. The reactive component of the reactive ink, when not completely replaced and left in the recording head, may react with a component of the ink for preservation when the recording head is preserved for extended periods before or during the delivery, possibly deteriorating functions of the head.

The term "reactive ink" used in this specification means the ink which includes a reactive component capable of reacting a colorant component of another ink, when it is mixed therewith, to form the precipitates. Some examples include color sets of a black ink and cyan, magenta or yellow color ink, wherein at least one of the color inks contains an additive (reactive component) which can degrade dispersion stability of the colorant in the black ink, when it is mixed therewith.

The present invention is developed to solve the above problems. It is an object of the present invention to provide a method of preserving a recording head which uses a reactive ink for recording to keep its designated functions without deteriorating them. It is another object of the invention to provide an ink jet system including a recording head in a suitable condition for preservation, and ink tank, removably attached thereto or detached therefrom, which are connected to each other when a reactive ink for recording is supplied into an ink flow path in the recording head for sustaining recording.

The first embodiment of the present invention relating to a method of preserving a recording head for ink jet which can attain the above object includes a liquid flow path by which the ink is supplied and a discharge port in communication with the ink flow path to discharge the ink supplied into the ink flow path; is connected to an ink tank in the recording apparatus in such a way to be removably attached to or detached from the ink tank, to allow the ink to be discharged from the discharge port; and uses a reactive ink as the recording ink containing a colorant and reactive component reactive with another ink, comprising a step of examining discharging conditions of the recording head using an ink for examination of a composition free of the reactive component, which is supplied into the ink flow path, and a step of preserving the recording head for preservation by replacing the ink for examination remaining in the ink flow path in the recording head by an ink for preservation containing neither the colorant nor reactive component, after the step of examining discharging conditions is over.

The recording head can be used for recording by, e.g., replacing the ink for preservation by the reactive ink for recording.

The recording head is preferably structured with a base comprising a board which supports a heat-generating resistor forming the heat-generating section, electrode wiring electrically connected to the heat-generating resistor and cavitation-resistant film provided on the heat-generating resistor and electrode wiring via an insulating/protective layer, wherein the ink flow path can be structured to correspond to the heat-generating section, and the cavitation-resistant film can have a Ta or TaAl film at least in the portion which comes into contact with the ink.

Moreover, the ink jet system of the present invention, kept in a suitable condition to be preserved, includes a recording head for ink jet and ink tank which can contain the ink, wherein the ink tank has a section which holds the reactive ink for recording, containing a colorant and reactive component reactive with another ink, the recording head includes a liquid flow path removably attached to or detached from the ink tank and supplied with the ink when attached to the tank, and a discharge port in communication with the liquid flow path, for discharging the ink supplied in the liquid flow path, the ink flow path being filled with the ink for preservation containing neither colorant nor reactive component which is to be replaced by the reactive ink for recording, and the recording head is structured with a base comprising a board which supports a heat-generating resistor forming the heat-generating section, electrode wiring electrically connected to the heat-generating resistor and cavitation-resistant film provided on the heat-generating resistor and electrode wiring via an insulating/protective layer and said ink flow path is structured to correspond to the heat-generating section, the cavitation-resistant film having a Ta or TaAl film at least in the portion which comes into contact with the ink.

The ink set suitably applicable to the method of the present invention for preserving a recording head having an ink for recording containing at least one type of reactive ink, wherein the recording ink has at least one combination of a non-reactive ink containing a colorant in a liquid medium and reactive ink containing a reactive component reactive with another ink and colorant in a liquid medium compositionally different from that for the non-reactive ink, and is further provided with the ink for preservation of the reactive and non-reactive inks, which is the reactive ink from which the colorant and reactive component are removed.

The second embodiment of the method of the present invention for preserving a recording head for ink jet which uses the Ink for preservation includes a liquid flow path by which the ink is supplied and a discharge port in communication with the ink flow path to discharge the ink supplied into the ink flow path; is connected to an ink tank in the recording apparatus in such a way to be removably attached to or detached from the ink tank, to allow the ink to be discharged from the discharge port; and uses a recording ink having at least one combination of a non-reactive ink containing a colorant in a liquid medium and reactive ink containing a reactive component reactive with another ink and colorant in a liquid medium compositionally different from that for the non-reactive ink, comprising a step of filling the ink flow path in the recording head with the ink for preservation, composed of the reactive ink from which the colorant and reactive component are removed, to make the recording head for preservation.

The ink for preservation for the ink set is used to preserve the recording head which uses the recording ink set containing at least one combination of non-reactive ink containing colorant in the liquid medium, and reactive ink containing reactive component reacting with another ink and colorant, and is composed of the reactive ink from which the colorant and reactive component are removed.

The liquid medium for the recording ink is composed of a liquid solvent component, e.g., water, incorporated, as required, with one or more additives.

The ink for preservation in this embodiment is composed of the reactive ink from which the colorant and reactive component are removed, wherein it may be compositionally the same as or different from the reactive ink for the other components. It preferably have the common composition for the other components, viewed from efficiency of the ink production.

Preservation of the recording head filled with the ink for preservation in the method of the present invention means that of the recording head while it is kept unused during the period from completion of the examination of the as-assembled recording head for its recording conditions to its delivery, during the delivery period, and/or the period for which it is stored by the user before use. Therefore, the preserved recording head may be stationary in a storehouse or moving during the delivery.

In the method of the present invention, the ink for examination free of the reactive component is supplied into the ink flow path in the recording head, while it is examined for its recording conditions, and is replaced by the ink for preservation on completion of the examination. No troubles will occur during the preservation period, even when the ink for examination is not completely replaced by the ink for preservation.

In the method of preserving the recording head which uses the above-described ink set has two or more ink flow paths each working independently to commonize the ink for preservation to be supplied into each of the ink flow paths in the recording head structured to discharge two or more types of ink. This allows common induction replaceability of the ink for preservation in each recording head or each chip having two or more recording heads on the same board while the ink for preservation is supplied into each ink flow path, e.g., for replacing the ink for examination, improving efficiency of the replacement procedure.

Commonizing the ink for preservation for each recording head or each chip having two or more recording heads on the same board eliminates the necessity of considering matching between the ink for preservation and the recording ink set including combination of reactive inks with a component different to each other and ink containing no reactive component, thereby allowing inkset configuration with a combination providing adequate performance of each ink.

BRIEF DESCRIPTION OF THE DRAWINGS

FIGS. 5A, 5B1 and 5B2 show the cavitation-resistant film changing with increased number of heater-driving pulses, due to high Ta corrosive property of ink;

DETAILED DESCRIPTION OF THE PREFERRED EMBODIMENTS

One embodiment of the recording head structure which can be suitably preserved by the method of the present invention is described below.

Figure 1A:
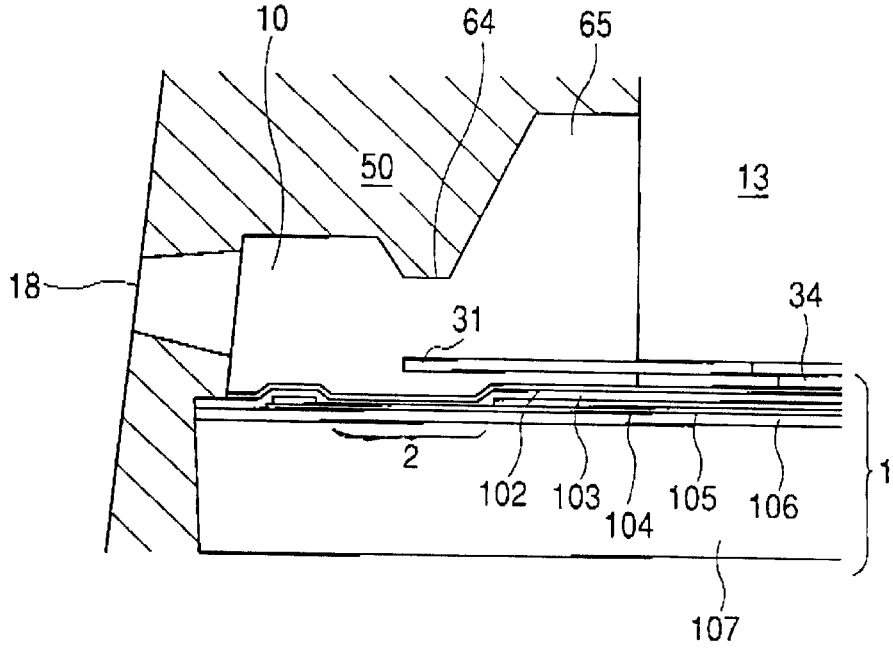
FIGS. 1A and 1B present the cross-sectional views in the longitudinal direction of the embodiments of the ink jet heads.
Figure 1B:
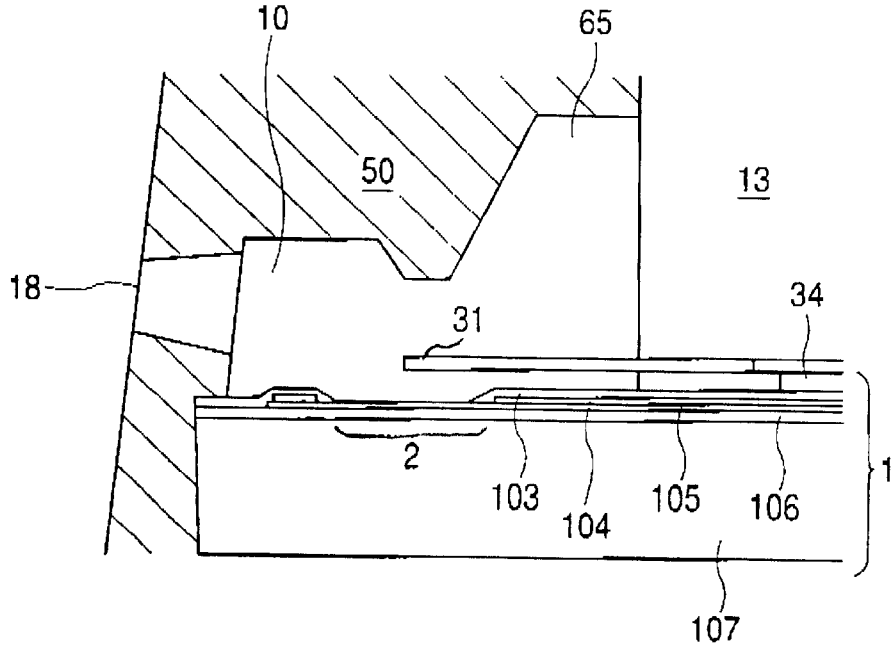

FIGS. 1A and 1B show a cross-sectional views of one embodiment of the recording head suitably applicable to the present invention, cut in the direction of the ink flow path.

The recording head includes the heat generator 2, as the discharge energy generating device which gives the ink a thermal energy to discharge it, on the flat device board 1, and also includes the ink flow path 10 corresponding to the heat generator 2 on the device board 1. The ink flow path 10 is in communication with the discharge port 18, and also with the common ink chamber 13 responsible for supplying ink to a plurality of the ink flow paths 10, each ink flow path receiving the same quantity of the ink as that discharged from the discharge port 18 from the chamber 13.

The device board 1 supporting the ink flow path 10 is joined with the ceiling plate 50 to provide the ink flow path 10 between them, and there is a bubble-generating region in the vicinity of the surface on which the ink to be discharged comes into contact with the heat generator 2, where the heat generator 2 is rapidly heated to form the bubbles in the ink. The movable member 31 is provided in the ink flow path 10 having the bubble-generating region in such a way that at least part of the member 31 faces the heat generator 2. The movable member 31 has the free end in the downstream, i.e., towards the discharge port 18, and is supported by the supporting member disposed in the upstream. The free end is disposed at almost the center of the bubble-generating region, in order to control growth part of the bubbles present in the upstream, which affects the flow of the ink back to the upstream and inertial force of the ink. The movable member 31 can be displaced from the supporting member 34, as the bubbles generated in the bubble-generating region grow, where the fulcrum 33 of the displacement is the point at which the movable member 31 is supported by the supporting member 34.

The stopper (restricting portion) 64 is located above the center of the bubble-generating region, to control displacement of the movable member 31, which controls growth part of the bubbles present in the upstream, in a certain range.

The low flow resistance region 65 of lower flow resistance than the ink flow path 10 is provided in the upstream of the flow of the ink from the common ink chamber 13 towards the discharge port 18, where the stopper 64 serves as the border between the upstream and downstream sides. The flow path in the region 65 is structured so as to reduce resistance of the ink flow from the path by, e.g., removing the upper wall or increasing the cross-section of the flow path.

This configuration provides the characteristic head structure in which the displaced movable member 31 comes into contact with the stopper 64 to provide a space in the ink flow path having the bubble-generating region 11 essentially closed except the discharge port 18.

Next, the positional relationship between the heat generator and movable member will be described. It is possible to adequately control and effectively utilize the liquid flow when the bubbles are formed by the heat generator by optimally disposing the heat generator and movable member.

The ink jet recording method, or the so-called bubble jet recording method, gives energy, e.g., heat, to the ink to cause the conditional changes involving rapid volumetric change (generation of the bubbles) of the ink, which drive the ink to be discharged from the discharge port 18 onto the recording medium to form the image thereon. In the conventional ink jet recording method, quantity of the ink discharged from the port changes in proportion to the heat generator area. However, it is found that there is a non-effective bubbling region S, which renders no contribution to ink discharging. It is also found that the non-effective bubbling region S is present around the heat generator, judging from its scorched conditions. It is accepted, based on these observations, that no contribution to foaming will be rendered within a width of around 4 $\mu$m from the heat generator surface.

This means that the effective region for fully utilizing the bubble pressure for the movable member is located immediately above the effective bubbling region within approximately 4 $\mu$m from the heat generator surface. It is noted in the present invention that the bubbles act independently on the ink flowing in the upstream of the flow path, and comprehensively on the ink flowing in the downstream, where the upstream and downstream sides are divided at almost the center (more exactly, in the range approximately ±10 $\mu$m from the center in the ink flow direction) of the bubble-generating region. It is therefore considered to be very important to dispose the movable member in such a way that it only faces the ink flowing in the upstream side. In the present invention, the effective bubbling region is set within approximately 4 $\mu$m from the heat generator surface. However, the region is not limited to the above, and may vary depending on type of the heat generator and how it is formed.

<Device Board>

Figure 2A:
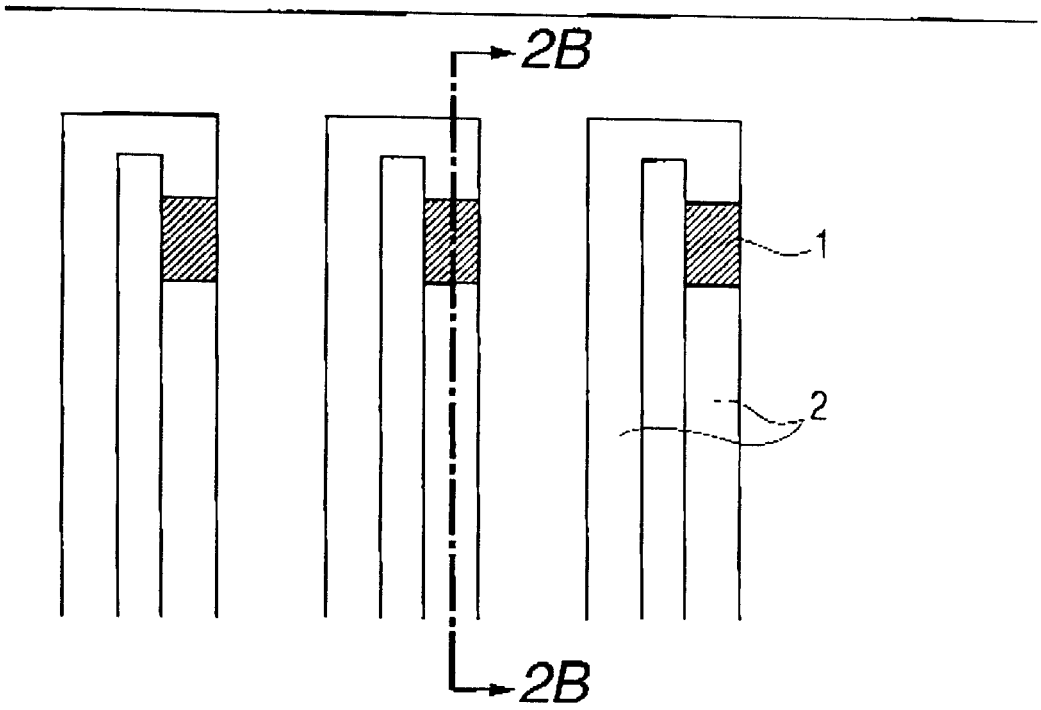
FIGS. 2A and 2B present the boards for the ink jet heads.

The device board (elemental substrate) 1 comprises the base 107 coated with the film 106 of silicon oxide or nitride for insulation and heat storage, electrical resistance layer 105 (0.01 to 0.2 $\mu$m thick) of hafnium boride ($HfB_2$), which also constitutes the heat generator 2, and tantalum nitride (TaN), tantalum aluminum (TaAl) or the like, in this order, on which the wiring-patterned electrode 104 (0.2 to 1.0 $\mu$m thick) of such as aluminum, shown in FIG. 2A, is formed. A voltage is applied to the resistance layer 105 from the wiring-patterned electrode 104, to generate heat by passing current through the resistance layer. The protective layer 103 of silicon oxide or nitride (0.1 to 2.0 $\mu$m thick) is formed on the resistance layer between the wiring-patterned electrodes. Further, the protective layer 103 is coated with the cavitation-resistant layer 102 of tantalum or the like (0.1 to 0.6 $\mu$m thick), to protect the resistance layer 5 from various liquids, e.g., ink.

The pressure and shock waves generated when the bubbles are produced or extinguished are sufficiently strong to greatly deteriorate durability of the hard, fragile oxide film, and the cavitation-resistant layer 102 of a metallic material, e.g., tantalum (Ta) is formed to protect the oxide film. Even when an ink containing a reactive component, e.g., salt of polyvalent metal, is used for the present invention, an ink free of the reactive component is used for the examination of printing conditions and replaced by the ink for preservation during the preservation period. Therefore, troubles, e.g., damages, of the Ta film as the cavitation-resistant film should not occur during the preservation period, even when it is exposed to the ink.

Figure 2B:
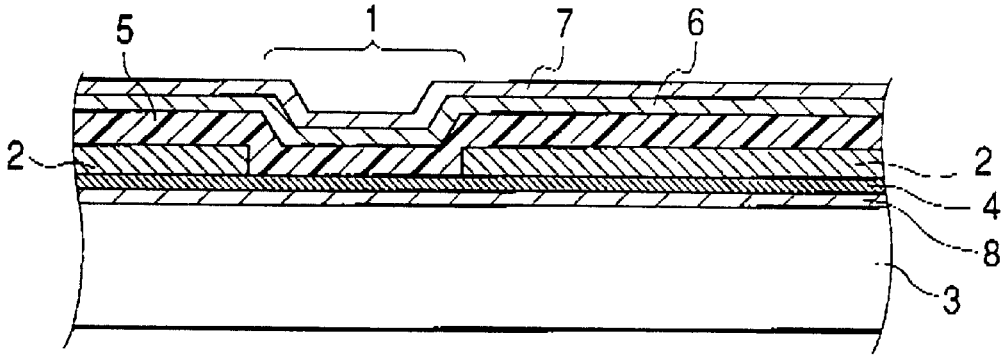

The device board 1 may not necessarily include the protective layer 103 to protect the resistance layer 105, depending on a combination of ink, ink flow path structure and resistance layer material. FIG. 2B shows this example. One of the examples of the protective layer 105 which needs no protective layer 103 is that of an iridium-tantalum-aluminum alloy.

As described above, the heat generator is structured to have the resistance layer (heat-generating section) between the electrodes, which may be protected by the protective layer or not.

In the present invention, a Ta-containing film is used at least at the part of the cavitation-resistant film coming into contact with the ink in the ink flow path through which the reactive ink is supplied. FIGS. 2A and 2B show the structure of the cavitation-resistance layer, which is preferably provided in the recording head discharging the reactive ink for recording. This structure may be also used in a head which discharges an ink free of the reactive component.

FIG. 2A schematically outlines a plan view of the head base, and FIG. 2B shows the cross-section of the head base shown in FIG. 2A, cut by the broken line 2B—2B.

As shown in FIGS. 2A and 2B, the Si board 3 is coated with a silicon oxide film as the heat-storage layer 8, heat-generating resistance layer 4, and Al layer as a pair of the wiring-patterned electrodes 2, in this order, each in a given pattern. The heat-generating resistance layer 4 placed in the space between a pair of the wiring-patterned electrodes 2 serves as the heat-generating section 20 responsible for rapidly heating and boiling the ink above.

The Si board 3 is further coated with a silicon nitride layer as the protective layer 5 to keep the space between the electrodes 2 insulated, in such a way to cover the heat-generating resistance layer 4 and wiring-patterned electrodes 2, and the cavitation-resistant layer, in this order. The cavitation-resistant layer comprises two layers, the lower cavitation-resistant layer 6 of Ta-containing amorphous alloy highly resistant to corrosion by the ink, and the upper cavitation-resistant layer 7 of Ta which shows relatively good anti-scorching characteristics, in this order from the board. The upper cavitation-resistant layer 7 is less resistant to corrosion by the ink than the lower cavitation-resistant layer 6.

The examples of the Te-containing amorphous alloy for the first cavitation-resistant layer 6 include that containing Fe, Ni and Cr, in addition to Ta. Use of such an alloy makes the layer 6 highly resistant to corrosion by the ink. It may further contain at least one type of element selected from the group consisting of Ti, Zr, Hf, Nb and W.

The amorphous alloy more preferably has a Ta-containing composition represented by the formula (I): $Ta\alpha Fe\beta Ni\gamma Cr\delta$ (wherein, $10\% \leqq \alpha \leqq 30\%$, $\alpha<\beta<80\%$, $a<\beta$, $\delta>\gamma$, and $\alpha+\beta+\gamma+\delta=100\%$, all percentages being by atom). In this case, Ta content is set at 10 to 30% by atom, which is lower than that for the above-described Ta-containing amorphous alloy. Decreasing Ta content to the above level can improve resistance of the alloy to ink, while keeping the adequate amorphous region in the alloy to make the passivation film, significantly reducing number of crystalline interfaces which provide the origins for the corrosion reactions, and keeping cavitation-resistant capacity at a good level.

In particular, the above alloy exhibits good effect of passivating the ink containing a divalent metal, e.g., Ca or Mg, or a component capable of forming a chelate complex, to prevent corrosion by the ink. It is more preferable that the compositional formula (I) satisfies 10 at.% $\leqq \alpha \leqq$ 20 at.%, $\gamma \geqq 7$ at.% and $\delta \geqq 15$ at.%, and still more preferably $\gamma \geqq 8$ at.% and $\delta \geqq 17$ at.%.

On the other hand, Ta for the second cavitation-resistant layer 7 has a crystal structure of tetragonal lattices, sometimes referred to as β-Ta, and is characterized by being slowly removed by cavitation generated while the bubbles are extinguished on the heat-generating section 20. The Ta film (layer) having the crystal structure of tetragonal lattices is formed by sputtering with metallic Ta (purity: 99% or more) as the target, as described later.

Next, the method of producing the recording head base of the above structure is described by referring to FIGS. 3A to 3D and 4A to 4D.

Figure 3A:
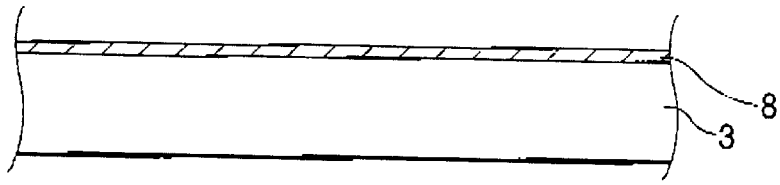
FIGS. 3A, 3B, 3C and 3D show the preceding steps of producing the board for ink jet head.

FIG. 3A shows the Si board 3 coated with a silicon oxide film to a thickness of 2,400 nm as the heat-storage layer 8 serving as the base for the heat-generating resistor by thermal oxidation, sputtering, CVD or the like.

Figure 3B:
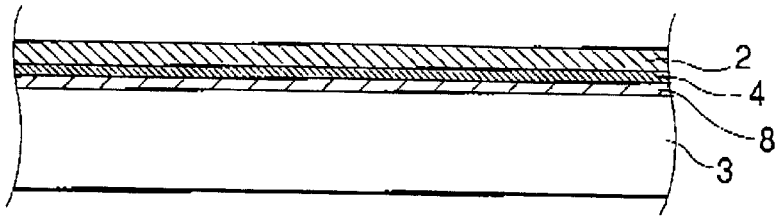

The heat-storage layer 8 is then coated with a TaN layer as the heat-generating resistance layer 4 to a thickness of around 100 nm by reactive sputtering, and with an Al layer as the wiring-patterned electrodes 2 to a thickness of 500 nm by sputtering, as shown in FIG. 3B.

Figure 3C:
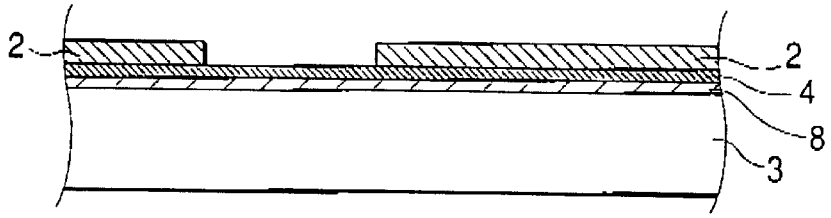

Then, the Al layer is wet-etched by photolithography, and the TaN layer is reactive-etched, to have the wiring-patterned electrode 2 and heat-generating resistance layer 4, as shown in FIG. 3C for the cross-sectional view (refer to FIG. 1A for the plan view). The heat-generating section 1 shown in FIGS. 2A and 2B corresponds to the part of the heat-generating resistance layer 4 uncoated with the Al layer, generating heat when the current is passed between the wiring-patterned electrodes 2 for the ink.

Figure 3D:
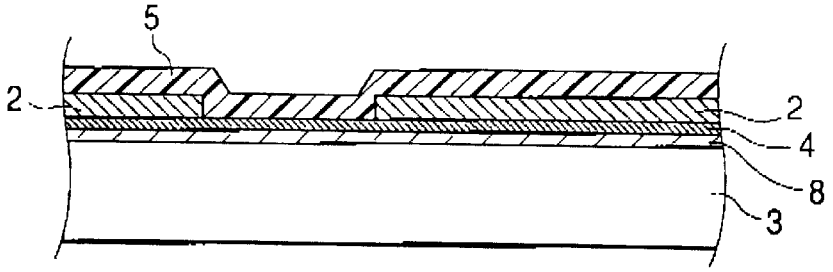

Then, the silicon nitride film as the protective film 5 is formed by sputtering to 1000 nm, and the Ta-containing amorphous alloy film having a composition of Ta: around 18%, Fe: around 60%, Cr: around 13% and Ni: around 9%, all by atom, as the lower cavitation-resistant film 6 is formed also by sputtering to around 100 nm, as shown in FIG. 3D. The Ta-containing amorphous alloy film may be formed by sputtering with a Ta—Fe—Cr–Ni alloy target, or by two-element, simultaneous sputtering with a Ta target and Fe—Cr—Ni alloy target each being separately supplied with power from its own power source.

Figure 4A:
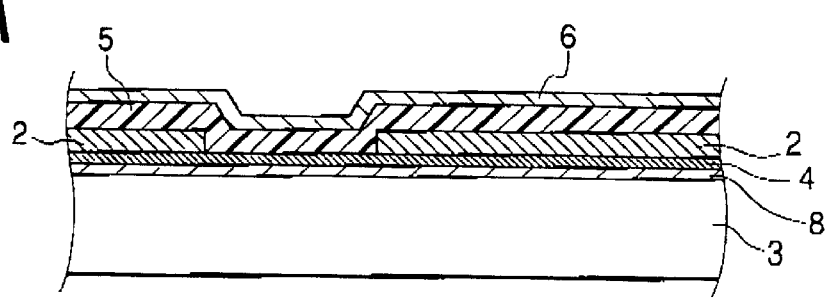
FIGS. 4A, 4B, 4C and 4D show the steps of producing the board for ink jet head, following those shown in FIGS. 3A, 3B, 3C and 3D.
Figure 4B:
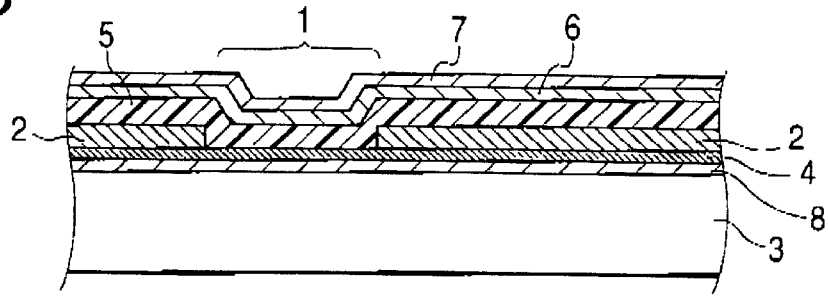

The Ta layer having the crystal structure of tetragonal lattices (referred to as β-Ta) is formed as the upper cavitation-resistant film 7 by magnetron sputtering with a metallic Ta target (purity: 99% or more, preferably 99.99%) to a thickness of around 150 nm, as shown in FIG. 4B. Another sputtering method other than magnetron sputtering may be used, so long as it can form the β-Ta of the above-described crystal structure.

When the upper cavitation-resistant film 7 is formed, the a-Ta (Cr—Fe—Ni) layer as the Ta-containing amorphous alloy film is doped with Ta in the surface layer section. This should make the surface area Ta-rich, although not changing the amorphous structure much in the a-Ta layer. It is also considered that the a-Ta (Cr—Fe—Ni) layer containing Cr at a relatively high content is doped with Ta also in the passivated surface layer of Cr or the like, to make it Ta-rich. At least this Ta-rich area conceivably improves durability of the protective layer.

Figure 4C:
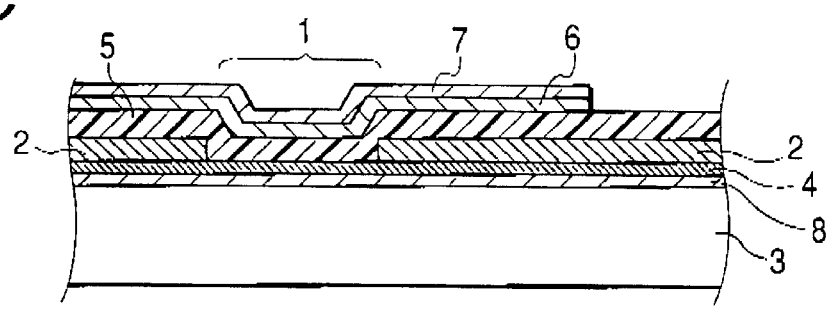

A resist pattern is formed on Ta by photolithography, and the upper Ta layer and lower Ta-containing amorphous alloy layer are successively etched with an etchant solution containing hydrofluoric and nitric acid as the main ingredients, to have a desired shape, as shown in FIG. 4C.

Figure 4D:
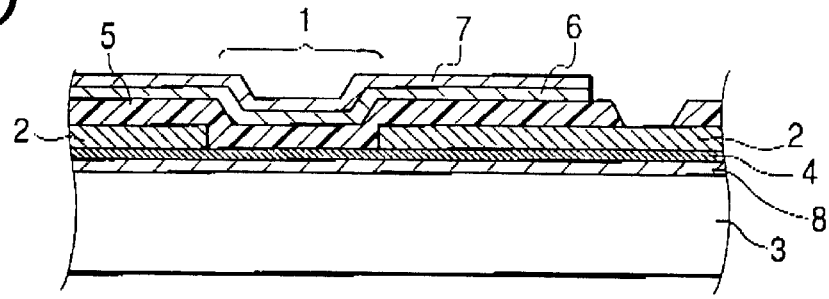

Then, the protective film is provided with a resist pattern by photolithography, and dry-etched with $CF_4$ gas to expose the electrode pad by the Al electrode required for connecting the electrode to an outside power source, as shown in FIG. 4D. This completes the production of the main section of the recording head base.

An integrated circuit for driving the heat-generating resistor may be incorporated in the same Si board, as disclosed by U.S. Pat. No. 4,429,321. In such a case, it is preferable that the integrated circuit section, like the wiring section, is covered with the protective layer 5, first cavitation-resistant film 6 and second cavitation-resistant film 7.

FIGS. 5A, 5B1 and 5B2 illustrate the cavitation-resistant film changing by the ink containing a polyvalent metal salt, which is corrosive to Ta, with increase in number of heater-driving pulses. FIGS. 5A, 5B1 and 5B2 present the enlarged part around the heat-generating section shown in FIG. 2B, wherein FIG. 5A for the film cross-section at a heater-driving pulse number of $2\times10^8$ or less, FIG. 5B1 for that at a heater-driving pulse number of more than $2\times10^8$ and FIG. 5B2 for the plan view of the cavitation-resistant film under the condition (B1), and B is the effective bubbling region and H is the heater region.

Figure 5A:
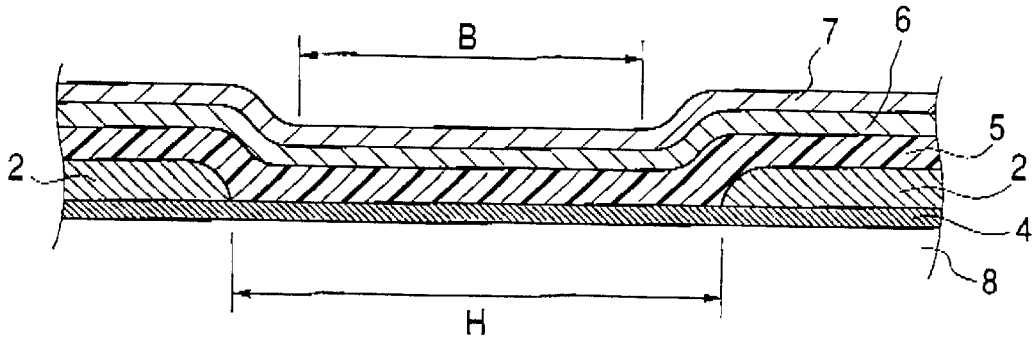
Figure 5A:
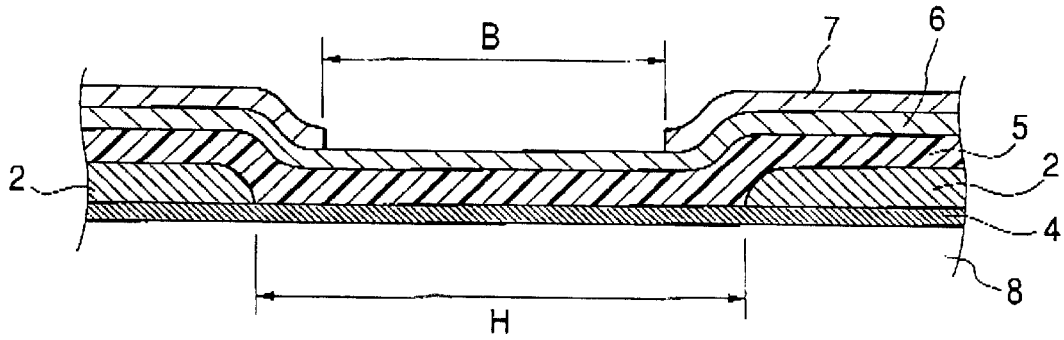
Figure 5A:
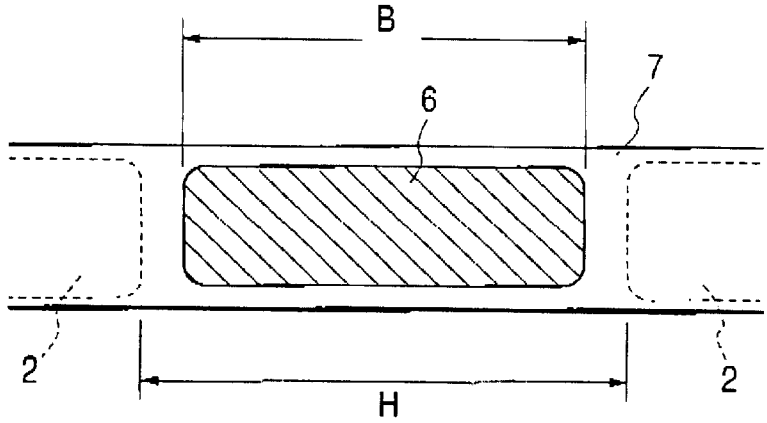

FIG. 5A shows the initial condition of the cavitation-resistant film 7, which is similar to that of the TaAl film as the cavitation-resistant film in place of the Ta film.

Increasing number of the heater-driving pulses from that corresponding to the initial condition shown in FIG. 5A slowly corrodes the part of the Ta film 7 coming into contact with the ink highly corrosive to Ta. The corrosion eventually stops at the interface between the Ta-containing amorphous alloy film 6 and Ta film 7 after exposing the Ta-containing amorphous alloy film 6 in the effective bubbling region, where the heat generated in the heater region, i.e., the region occupied by the heat-generating resistor between the wiring-patterned electrodes, effectively acts on the ink to bubble, as shown in FIGS. 5B1 and 5B2. This phenomenon will be observed when the Ta-containing amorphous alloy film as the lower cavitation-resistant film 6 is replaced by another type of film similarly resistant to the ink, e.g., film with an oxide film containing chromium oxide on the surface as the lower cavitation-resistant film 6.

As the corrosion proceeds from the condition shown in FIG. 5A to that shown in FIG. 5B1, the β-Ta layer being eroded is exposed to the cavitation-caused pressure generated while the ink bubbles are formed. As a result, the amorphous structure or passivated film thereof in the surface area of the Ta-containing amorphous alloy layer below the β-Ta layer is doped with Ta. In other words, the amorphous structure or passivated film thereof in the surface area of the Ta-containing amorphous alloy layer is substantially doped with Ta during the aging step for the head production process (preliminary discharging of the ink droplets in the final stage of the head production process) or by the actions of the bubbles extinguishing as the ink is discharged while the head is in service. This phenomenon, referred to as back sputtering, can help make the cavitation-resistant film more durable and resistant to scorching on the surface or as a whole. For this reason, the amorphous structure or passivated film thereof in the surface area of the Ta-containing amorphous alloy layer may be doped β-Ta before it is subjected to the ink, or to be exposed later, when the recording head base of head provided therewith is set in the recording apparatus. These heads have their own advantages: the former can have a stable discharge rate from the very initial start-up, while the latter has an additional period of resistance to scorching until the initial surface is removed by the cavitation.

Figure 6:
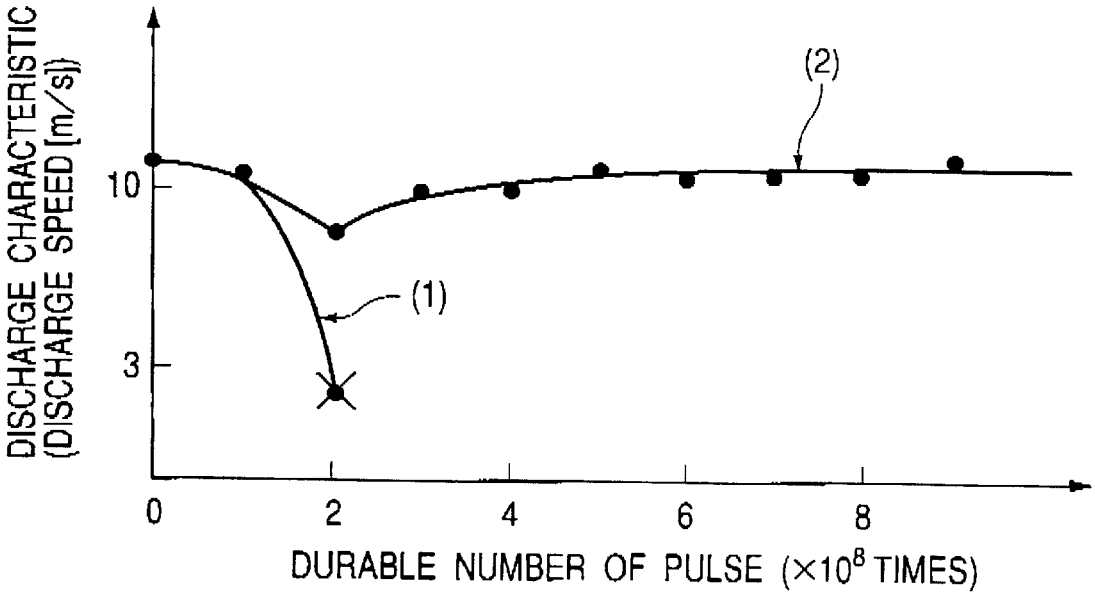
FIG. 6 shows a graph for comparing the life of a cavitation-resistant film of the present invention, composed of Ta in the upper layer and Ta contained amorphous alloy in the lower layer, and the life of a cavitation-resistant film composed of only one layer of Ta, where ink with high Ta corrosive property is used.

As discussed above, the heater section for the present invention has much longer serviceability and keeps better bubbling efficiency than the conventional one protected by the cavitation-resistant film comprising only one Ta layer, as shown in FIG. 6, where the curve (1) represents the serviceability of the heater section protected by the cavitation-resistant film comprising only one Ta layer and the curve (2) that protected by the cavitation-resistant film comprising two layers, the upper Ta layer and lower Ta-containing amorphous alloy layer.

The heat-generating section described above includes the resistance layer generates heat in accordance with the electric signals it receives. However, the heat-generating device for the present invention is not limited to the above, and any one may be used so long as it can generate a sufficient quantity of bubbles to discharge the ink. Some of the examples include a photothermal converter which generates heat when irradiated with light, e.g., laser beams, and another one which generates heat when irradiated with radio-frequency waves.

The device board 1 described above supports the electrothermal converter comprising the resistance layer 105 which constitutes the heat-generating section and wiring-patterned electrode 104 which supplies the electrical signals to the resistance layer 105. The heat-generating section may be further incorporated with a functional device, e.g., transistor, diode, latch and shift resistor, to selectively drive the electrothermal converter in the semiconductor production line, to form a monolithic assembly.

The device board 1 of the above structure controls accumulated occurrence of scorching of the heat-generating section to prevent deterioration of bubbling efficiency, even with the ink tending to cause scorching, because the upper Ta film is eroded little by little as number of the heater-driving pulses increases. With the ink highly corrosive to Ta, on the other hand, the upper Ta film is eroded as number of the heater-driving pulses increases, but the corrosion eventually stops at the interface between the Ta-containing amorphous alloy film and Ta film. Therefore, the head board can satisfy sufficient serviceability and reliability simultaneously, even when different types of inks, one type tending to cause more scorching and another highly corrosive to Ta, are supplied to a plurality of the heat-generating sections arranged in a row on the head board.

When the protective layer of amorphous alloy having a composition represented by the formula $Ta\alpha Fe\beta Ni\gamma Cr\delta$ (wherein, $10\% \leqq \alpha \leqq 30\%$, $\alpha<\beta<80\%$, $a<\beta$, $\delta>\gamma$, and $\alpha+\beta+\gamma+\delta=100\%$, all percentages being by atom) is used as the first cavitation-resistant film, a passivated film is formed on the surface.

When the passivated film is coated with the second cavitation-resistant film formed by sputtering metallic Ta having a purity of 99% or more, it is considered that some durability-improving structural changes occur in the interface between the Ta film as the second cavitation-resistant film having a crystal structure of tetragonal lattices and the above-described protective layer of amorphous alloy, or in the surface area of the protective layer of amorphous alloy (i.e., passivated film of Cr, Ta or the like).

The first possible cause will be the passivated film region containing Cr and Ta being substantially doped with Ta, which is used for the second cavitation-resistant film, when the latter is formed by magnetron sputtering. This modifies the amorphous passivated film containing Ta or Cr as amorphous Ta (or Fe—Ni—Cr), to remove the causes for scorching and thereby to improve durability of the cavitation-resistant film.

Based on the above conception, the present invention is well serviceable when it comprises the recording head board and recording head equipped therewith which includes the Ta-doped amorphous passivated film containing at least Cr and Ta as the surface area before it is subjected to the ink, or to be exposed later. Each case has its own advantage: the former can have a stable discharge rate from the very initial start-up, while the latter has an additional period of resistance to scorching until the initial surface is removed by the cavitation.

The second possible cause will be Ta of tetragonal lattice crystal structure (i.e., β-Ta) formed on the amorphous structure in the first cavitation-resistant film fast remaining on the amorphous structure surface, to modify the surface, and thereby to improve its durability and its effect of preventing itself form being scorched.

The second cause may take place in combination with the first cause. In any case, the second cause, like the first cause, will exhibit its effects independently, and have the meaning as the invention when regarded as the one forming the "structure with Ta added to its surface," in place of the "Ta-doped layer" formed by the first cause.

The third possible cause will be the amorphous structure or passivated film thereof in the first cavitation-resistant film being doped with Ta, which plays an important role at least in one of the first and second causes, as the β-Ta layer being eroded (or corroded) is exposed to the pressure produced by the cavitation.

In other words, the amorphous structure or passivated film thereof is substantially doped with Ta during the aging step for the head production process (preliminary discharging of the ink droplets in the final stage of the head production process) or by the actions of the bubbles extinguishing as the ink is discharged while the head is in service. This phenomenon, referred to as back sputtering, can help make the cavitation-resistant film more durable and resistant to scorching on the surface or as a whole, when it act on the Ta to be eroded (or corroded), fast adhered to the amorphous structure surface or present in the passivated film as the dopant.

It can be understood, needless to say, that the aging step for the head production process can be used to remove crystal structure film of β-Ta when obtaining the first factor as the first ink-contacting-to-liquid surface. The composite, whether it is produced based on the first, second and third causes or first and third causes can be used for the present invention.

<Ink Tank, and Recording Head>

Next, the preferred embodiments of the present invention are described by referring to the drawings.

Figure 7A:
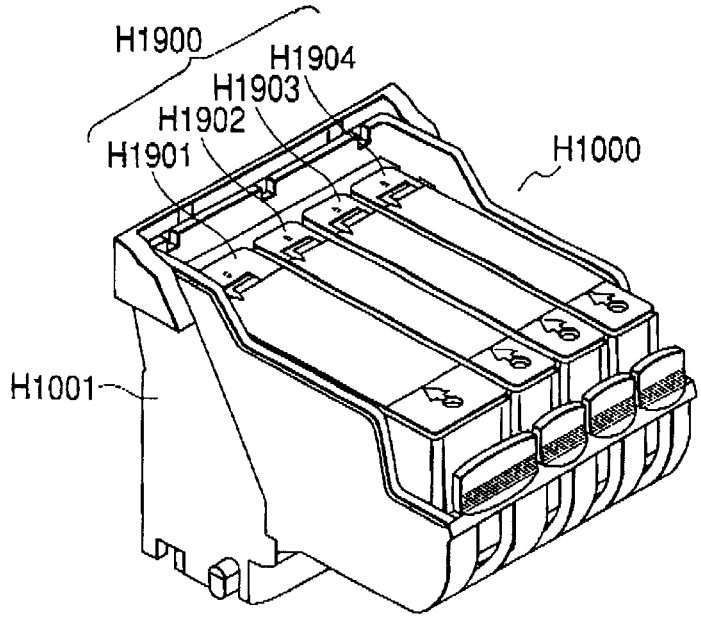
FIG. 7A shows a perspective view of a recording head cartridge suitable for an ink jet recording apparatus to which a color ink jet recording method is implemented or applied and 7B shows an exploded perspective view thereof.
Figure 7B:
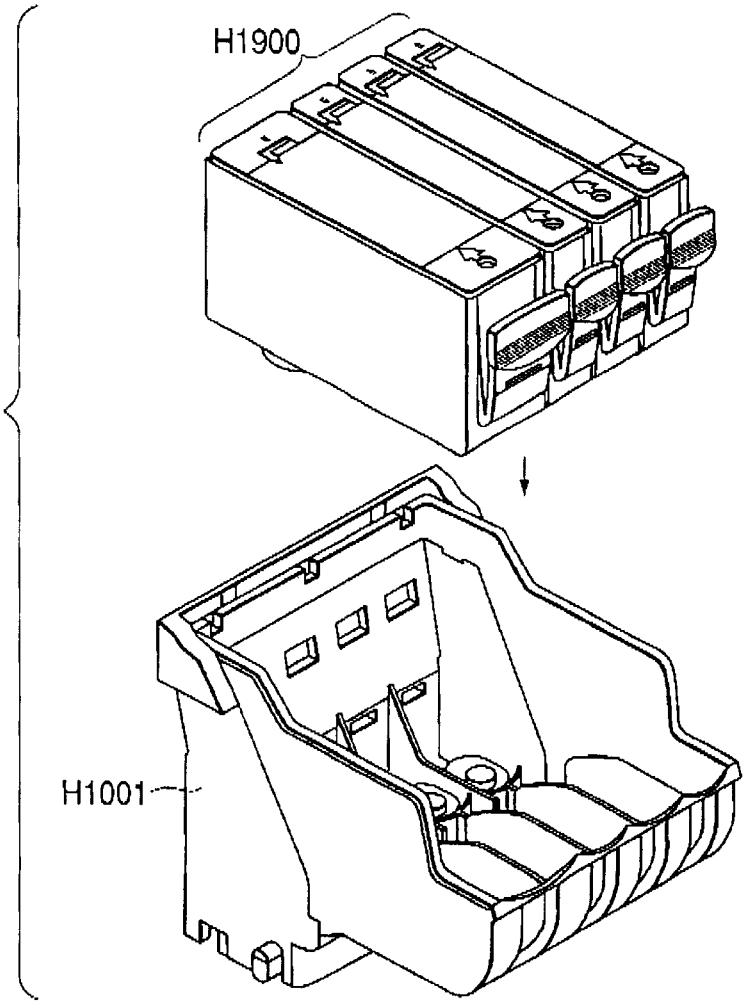
Figure 8:
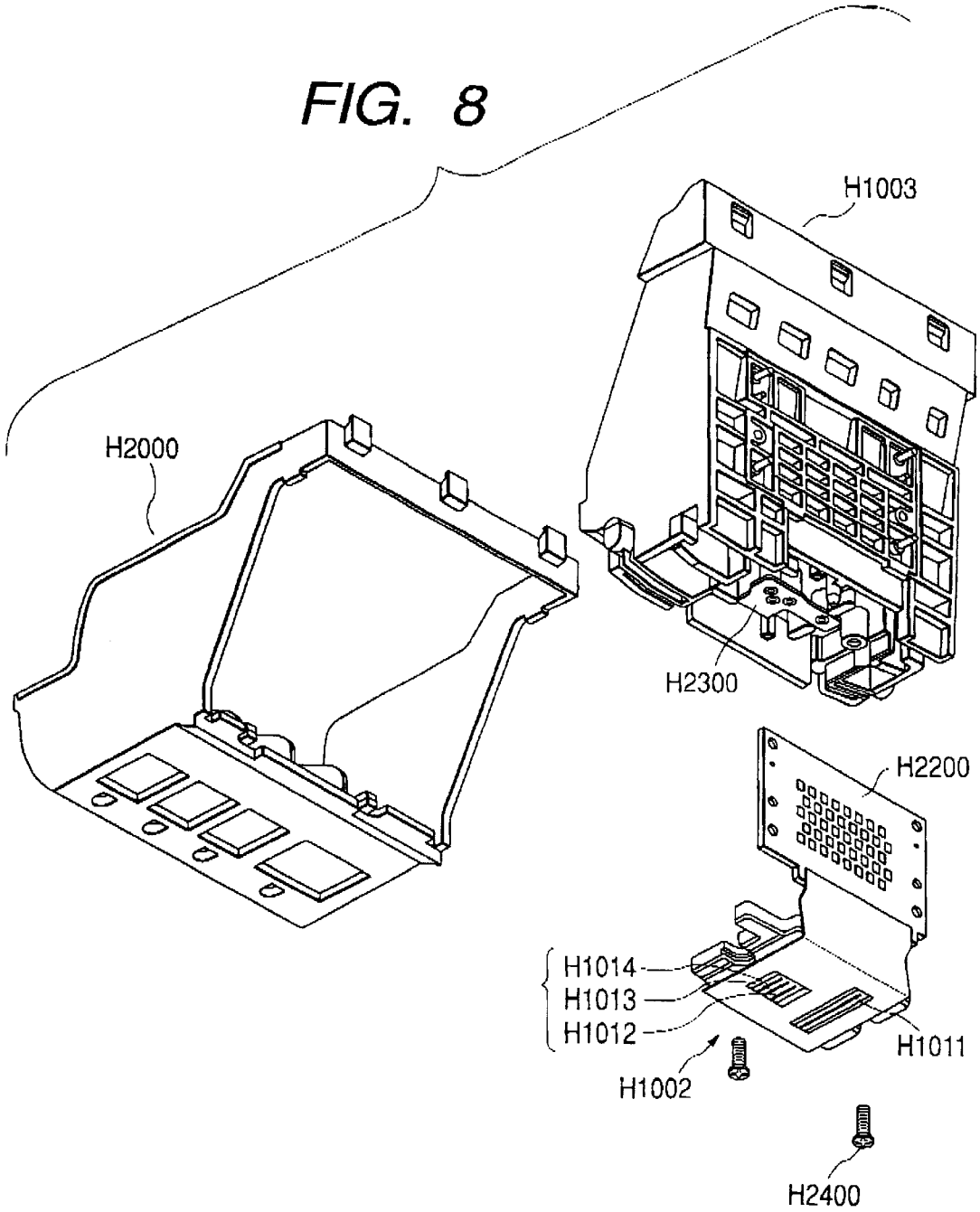
FIG. 8 shows an exploded perspective view of a recording head configuration shown in FIGS. 7A and 7B.

FIGS. 7A and 7B present the oblique views of one embodiment of the present invention, FIGS. 7A and 7B for the assembled and disassembled recording head cartridge. FIG. 8 presents the oblique view of the disassembled recording head structure shown in FIGS. 7A and 7B, and FIG. 9 the oblique view showing the bottom side of the head. Each structural component is described by referring to these drawings.

The recording head H1001 is a one structural component for the recording head H1001, which is composed of the recording head H1001 and ink tank H1900 (H1901, H1902, H1903 and H1904) removably attached to or detached from the recording head H1001. The recording head H1001 discharges, from the discharge port, the ink (recording solution) supplied from the ink tank H1900 in accordance with recording information it receives.

The head cartridge H1000 is fixed and supported by a carriage (not shown) positioning means, set in the main body of the ink jet recording apparatus, and electrical contact point, and removably attached to or detached from the carriage. The ink tank H1901 is for the black ink, the ink tank H1902 for the cyan ink, ink tank H1903 for the magenta ink, and ink tank H1904 for the yellow ink. Each of the ink tanks H1901, H1902, H1903 and H1904 is removably attached to or detached from the recording head H1001, and exchangeable, to reduce the running cost of the ink jet recording apparatus.

The recording head H1001 is of bubble jet, side chute type, working by the aid of an electrothermal converter (recording device) which generates thermal energy to cause film boiling in the ink in accordance with the electrical signals it receives.

Figure 9:
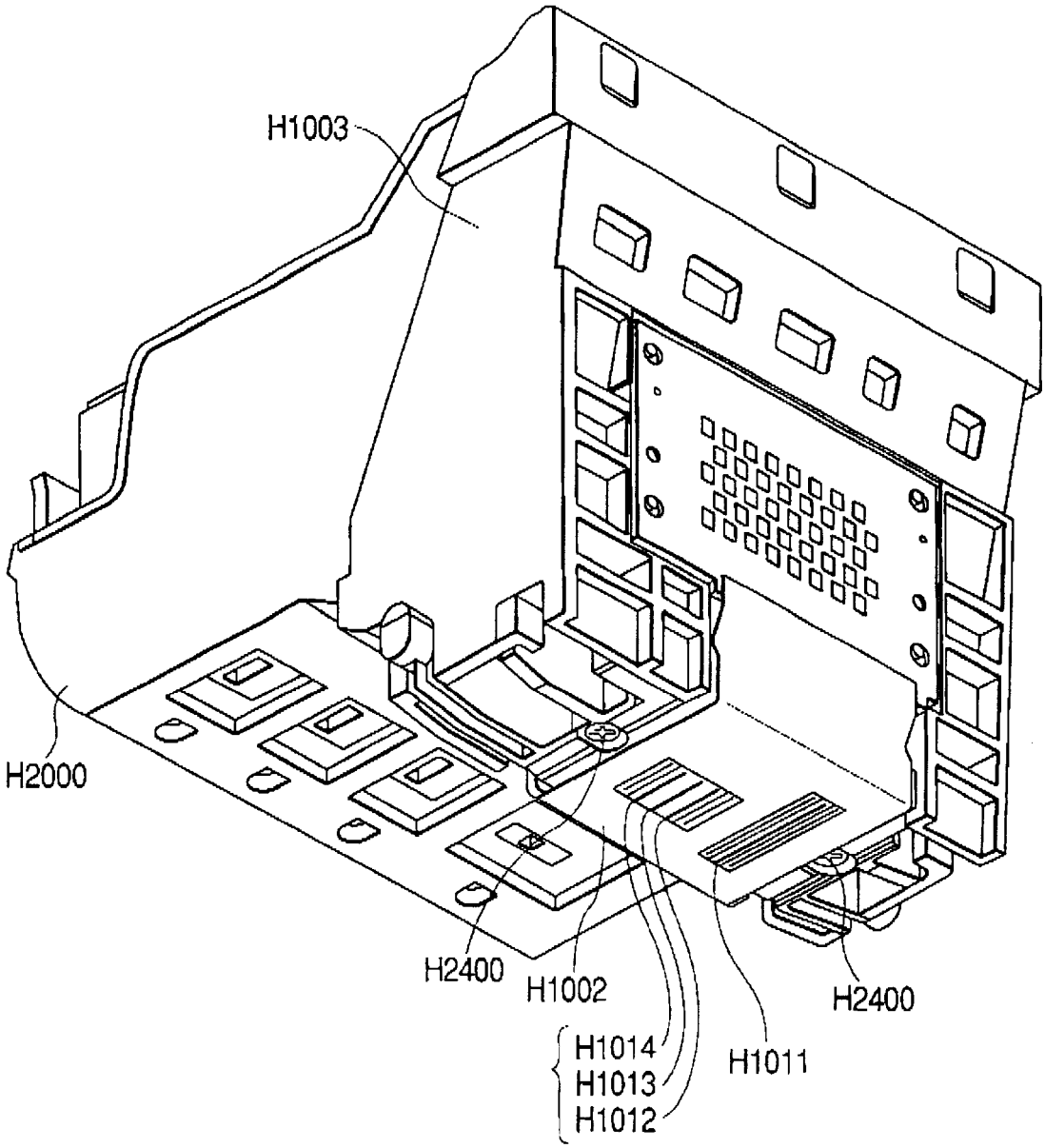
FIG. 9 shows a perspective view of a bottom side of the recording head shown in FIGS. 7A and 7B.

The recording head H1001 is composed of the recording device unit H1002, ink supplying unit H1003 and tank holder H2000, as shown in FIG. 8 which presents the oblique view of the disassembled structure. The recording head H1001 is completed by connecting the recording device unit H1002 to the ink supplying unit H1003 and tank holder H2000 by the screws H2400, as shown in FIG. 8. FIG. 9 present the assembly. When the recording device unit H1002 is connected to the ink supplying unit H1003, the recording device unit H1002 and the ink supplying unit H1003 are connected to each other at the ink communication ports in such a way that these ports are pressed to each other and fixed via the joint seal member H2300 by the screws H2400, to prevent leakage of the ink.

The electrical contact board H2200 of the recording device unit H1002 is set on one side of the ink supplying unit H1003, after being positioned by the two terminal positioning pins in the ink supplying unit H1003 and two corresponding positioning holes in the electrical contact board H2200. The electrical contact board H2200 can be set by chalking the terminal connecting pins in the ink supplying unit H1003 or using another fixing means. The recording head H1001 is completed when the tank holder H2000 is fit in the connecting hole and connecting section in the ink supplying unit H1003.

The recording device unit H1002 is provided with a row of discharge ports H1011 for discharging the black ink supplied from the ink tank H1901, a row of discharge ports H1012 for discharging the cyan ink supplied from the ink tank H1902, a row of discharge ports H1013 for discharging the magenta ink supplied from the ink tank H1903, and a row of discharge ports H1014 for discharging the yellow ink supplied from the ink tank H1904, as shown in FIGS. 8 and 9. These rows H1011, H1012, H1013 and H1014 are running in parallel to each other, in this order.

FIGS. 7A and 7B show the ink tank H1009 (H1901, H1902, H1903 or H1904) being set in the recording head H1001 to complete the recording head cartridge H1000, where each of the ink tanks H1901, H1902, H1903 and H1904 holds the ink of the designated color. Each ink tank includes the ink communication port by which the ink it holds is supplied to the recording head H1001. For example, when the ink tank H1901 is set in the recording head H1001, the ink communication port of the ink tank H1901 is pressed to the filter provided at the joint with the recording head H1001, and the black ink in the ink tank H1901 can be supplied from its ink communication port to each of a row of the discharge ports H1011 via the ink flow paths in the recording head H1001.

The ink is supplied to the bubbling chamber provided with the electrothermal converter and discharge port, and discharged onto the recording paper as the recording medium by the thermal energy given to the electrothermal converter.

Each of the cyan, magenta and yellow color inks held by one of the ink tanks H1902 to 1904 is selected from the ones penetrating fast into the recording paper, to prevent its bleeding at the border between the different colors, when a color image is produced.

On the other hand, the black ink held by the ink tank 1901 penetrates into the recording paper more slowly than any of the above three color inks, to have the high-quality black image of high concentration and showing little feathering.

In the method of the present invention for preserving the recording head, the final product is examined for the printed conditions by, e.g., the following procedure. The recording head and ink tank filled with the ink for examination are assembled to have the recording head cartridge, as shown in FIG. 7A, which is set at the designated position in the recording apparatus for examination. When, for example, the ink tank H1903 is to be filled with the reactive ink while in printing service, it is filled with the ink for examination which is the reactive ink from which the reactive component is removed during the examination period. On completion of the examination, the ink for printed condition examination remaining in the recording head is replaced by the ink for preservation using a liquid supplying system of designated structure.

The ink tank filled with the ink for preservation in the examined recording head is sealed by adequate means to prevent leakage of the ink out of the tank, while it is kept unused during the period from completion of the examination of the recording head to its delivery, during the delivery period, and/or the period for which it is stored by the user before use, as described earlier.

When delivered, a set of the recording head filled with the ink for preservation and the one filled with a designated ink for recording ink may be sent out of the factory as an ink jet system.

Next, the inks useful for the present invention are described.

The reactive ink used for the present invention includes a reactive component which, when mixed with another ink, promotes dissolution of a colorant of the another ink, or degrades dispersion stability of the colorant. One of the examples of these combinations is a color set of black ink with a pigment as the colorant and color ink including a polyvalent metal salt which can degrade dispersion stability of the colorant.

More concretely, degradation of dispersion stability of the colorant in the black ink for a color set means the phenomenon of, e.g., agglomeration or precipitation of the colorant particles or thickening of the black ink. Thickening means the phenomenon that a mixed ink of the black and color inks has a higher viscosity than each of its component before mixing. (Reactivity between the black and color inks)

It is preferable that each of the black and color inks for the present invention is prepared to have a composition which contains a component capable of degrading dispersion stability of the colorant in the black ink, when they are mixed with each other. As one of the concrete examples, the color ink for such a color set contains a polyvalent metal salt as the additive which can degrade dispersion stability of the pigment in the black ink, when it is mixed with the black ink. One of the concrete examples of these combinations is that of the black ink containing a colorant having an anionic group and color ink containing a polyvalent metal salt having a polyvalent metal cation, e.g., that containing at least one type of divalent or trivalent metal salt having a polyvalent metal cation selected from the group consisting of $Mg^{2+}$, $Ca^{2+}$, $Cu^{2+}$, $Co^{2+}$, $Ni^{2+}$, $Fe^{2+}$, $La^{3+}$, $Nd^{3+}$, $Y^{3-}$ and $Al^{3+}$. One or more polyvalent metal salts may be used to supply at least one of the above-described divalent metal cations to the ink.

In one of the above examples, the polyvalent cation of the polyvalent metal salt in the color ink reacts with the anionic group of the colorant in the black ink, when these inks are mixed with each other, to destroy dispersion of the colorant in the black ink, and thereby to agglomerate the colorant particles and thicken the ink. The polyvalent metal salt is preferably incorporated at, e.g., about 0.1 to 15% by weight, based on the whole color ink.

Use of such a color ink set will bring a favorable effect that difference in image density between the image formed with the black ink alone and that formed with overlapping black and color inks to control bleeding is reduced to an extent essentially not visible to the naked eye. Thus, a high-density image can be produced by overlapping the pigment-containing black ink and color ink containing an additive which can degrade dispersion stability of the pigment in the black ink, in order to relax bleeding or fogging. (Black ink)

The suitable colorants for the black ink include carbon black. It may be of self-dispersion type or dispersed in the ink by the aid of dispersant.

(Self-dispersion Type Carbon Black)

One of the examples of the self-dispersion type carbon black is the one having at least one type of hydrophilic group (either anionic or cationic) as the ionic group bonded to the carbon black surface, either directly or indirectly via another group. Use of this type of carbon black reduces a required quantity of dispersant, or even dispenses with the dispersant.

For the carbon black with an anionic group bonded to the surface, either directly or indirectly via another group, the examples of the hydrophilic groups include —COO(M2), —$SO_3$(M2), —$PO_3$H(M2) and —$PO_3$ $(M2)_2$, wherein "M2" is hydrogen atom, an alkali metal, ammonium or organic ammonium. Of these, —COO(M2) and —$SO_3$(M2) are more preferable for the present invention, because the self-dispersing carbon black charged anionic therewith is well dispersible in the ink.

Of the hydrophilic groups represented by "M2", the concrete examples of the alkali metals include Li, Na, K, Rb and Cs, and those of the organic ammonium include methyl ammonium, dimethyl ammonium, trimethyl ammonium, ethyl ammonium, diethyl ammonium, triethyl ammonium, methanol ammonium, dimethanol ammonium, trimethanol ammonium.

The ink containing the self-dispersing carbon black for the preferred embodiment of the present invention with ammonium or organic ammonium as M2 can further improve resistance of the recorded image to water, and hence especially suitably used in this respect. This conceivably results from decomposition of ammonium followed by evaporation of ammonia, after the ink is discharged onto the printing medium to form the image thereon. The self-dispersing carbon black with ammonium as M2 is produced by, e.g., treating a self-dispersing carbon black with an alkali metal as M2 by ion-exchanging to substitute the alkali metal by ammonium, or transforming the carbon black with an alkali metal into the H type in the presence of an acid and substitution of the M2 by ammonium in the presence of ammonium hydroxide.

The self-dispersing carbon black charged anionic can be produced by, e.g., oxidation of carbon black with sodium hypochlorite, which chemically bonds —COONa group to the carbon black surface.

For the carbon black with a cationic group bonded to the surface, either directly or indirectly via another group, the examples of the hydrophilic groups include the one bonded to at least one of the quaternary ammonium group selected from the group consisting of those represented by the followings:

[Chemical formula 1]

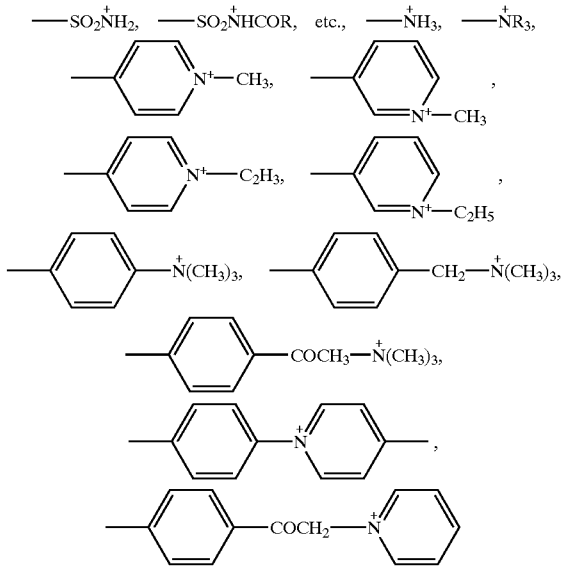

wherein, R is a straight-chain or branched alkyl group of 1 to 12 carbon atoms, phenyl group which may have a substituent or naphthyl group which may have a substituent.

It should be noted that the above-described cationic group has a counter ion, e.g., $NO_3^-$ or $CH_3COO^-$.

One of the methods for producing the self-dispersing carbon black charged cationic with the hydrophilic group bonded thereto is bonding N-ethylpyridyl group, for example, represented by the following structure, to the surface:

[Chemical formula 2]

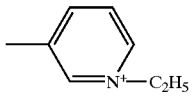

In this method, carbon black is treated with 3-amino-N-ethylpyridinium bromide. The carbon black thus charged anionic or cationic with a hydrophilic group bonded to the surface can be kept stably dispersed in an aqueous ink even in the absence of additive, e.g., dispersant, because of the resultant repulsion between the ions to make the carbon black well dispersible in water.

A variety of the hydrophilic groups described above may be bonded to the carbon black surfacer either directly or indirectly with another group between the carbon black surface and hydrophilic group. The concrete examples of the groups capable of serving as the mediator between the carbon black surface and hydrophilic group include a straight-chain or branched alkylene group of 1 to 12 carbon atoms, phenylene group which may be substituted or not substituted, and naphthylene group which may be substituted or not substituted. The examples of the substituents for phenylene and naphthylene groups include a straight-chain or branched alkyl group of 1 to 6 carbon atoms. The examples of the combinations of the hydrophilic group and the group by which it is bonded to the carbon black surface include —$C_2H_4$COO(M2), —Ph—$SO_3$(M2) and —Ph—COO(M2), wherein Ph is phenyl group.

In this embodiment two or more types of the adequately selected self-dispersing carbon black described above may be used as the ink colorants. The self-dispersing carbon black for the ink is incorporated at 0.1 to 15% by weight based on the whole ink, preferably 1 to 10% by weight. The self-dispersing carbon black will be kept well dispersed in the ink, when present at a content in the above range. It may be incorporated with a dye as the colorant, for the purposes, e.g., adjusting hue of the ink.

(Common Carbon Black)

The black ink may contain a common carbon black, which is not self-dispersing, as the colorant.

The examples of such carbon black include a carbon black pigment, e.g., furnace black, lamp black, acetylene black or channel black, including Raven 7000, Raven 5750, Raven 5250, Raven 5000ULTRA-, Raven 3500, Raven 2000, Raven 1500, Raven 1250, Raven 1200, Raven 1190ULTRA-11, Raven 1170 and Raven 1255 (Columbia); Black Pearls L, Regal 400R, Regal 330R, Regal 660R, Mogul L, Monarch 700, Monarch 800, Monarch 880, Monarch 900, Monarch 1000, Monarch 1100, Monarch 1300, Monarch 1400 and Valcan XC-72R (Cabot); Color Black FW1, Color Black FW2, Color Black FW2V, Color Black FW18, Color Black FW200, Color Black S150, Color Black S160, Color Black S170, Printex 35, Printex U, Printex V, Printex 140U, Printex 140V, Special Black 6, Special Black 5, Special Black 4A, Special Black 4 (Degussa); and No. 25, No. 33, No. 40, No. 47, No. 52, No. 900, No. 2300, MCF-88, MA600, MA7, MA8 and MA100 (Mitsubishi Chemicals), although not limited thereto, and common carbon black products other than the above can be used.

Moreover, fine magnetic particles, e.g., those of magnetite or ferrite, titanium black or the like may be used for the black pigment.

It is preferable, when the above-described common carbon black is used as the colorant, that the black ink is incorporated with a dispersant to stably disperse the colorant in an aqueous medium.

The suitable dispersants for the present invention include those having, e.g., ionic group which can help disperse the carbon black stably in an aqueous medium. The concrete examples of these dispersants include styrene/acrylic acid copolymer, styrene/acrylic acid/alkyl acrylate ester copolymer, styrene/maleic acid copolymer, styrene/maleic acid/alkyl acrylate ester copolymer, styrene/methacrylic acid copolymer, styrene/methacrylic acid/alkyl acrylate ester copolymer, styrene/maleic acid half ester copolymer, vinyl naphthalene/acrylic acid copolymer, vinyl naphthalene/maleic acid copolymer, styrene/maleic anhydride/maleic acid half ester copolymer, and salts thereof. Of these, those having a weight-average molecular weight of 1,000 to 30,000, more preferably 3,000 to 15,000.

(Salt for Black Ink)

The black ink for the present invention preferably contains at least one salt selected from the group consisting of $(M1)_2SO_4$, $CH_3COO(M1)$, Ph—COO(M1), $(M1)NO_3$, (M1)Cl, (M1)Br, (M1)I, $(M1)_2SO_3$ and $(M1)_2CO_3$, wherein M1 is an alkali metal, ammonium or organic ammonium; and Ph is phenyl group.

The concrete examples of the alkali metals include Li, Nar K, Rb and Cs, and those of the organic ammonium include methyl ammonium, dimethyl ammonium, trimethyl ammonium, ethyl ammonium, diethyl ammonium, triethyl ammonium, trimethanol ammonium, dimethanol ammonium, trimethanol ammonium, ethanol ammonium, diethanol ammonium and triethanol ammonium.

Of these salts, sulfates (e.g., potassium sulfate) and zenzoate (e.g., ammonium benzoate) are more preferable, because they are compatible with the self-dispersing carbon black, and can form ink jet recording images of very high quality on a variety of recording media, the concrete reason for which will be their particularly excellent solid/liquid separation effect when put on the recording medium.

The ink containing a colorant dispersed in an aqueous medium by the actions of the ionic group, e.g., that containing self-dispersing carbon black, can stably form the high-quality images not changing much in image quality irrespective of recording medium type, when the above-described salt is coexisting in the ink.

The colorant, e.g., self-dispersing carbon black, in the black ink for the present invention is incorporated at 0.1 to 15% by weight, based on the whole ink, preferably 1 to 10%. On the other hand, the salt is incorporated at 0.05 to 10% by weight, based on the whole ink, preferably 0.1 to 5%. The colorant and salt, when present in the black ink at a concentration in the above range, can bring about more excellent effects.

When the self-dispersing carbon black is used as the colorant, it has a hydrophilic group bonded to the surface, and those hydrophilic groups suitably selected include —COO(M2), —$SO_3$(M2), —$PO_3H$(M2) and —$PO_3$ $(M2)_2$, wherein M2 is ammonium or organic ammonium, as described earlier. One of the preferred embodiments of the preset invention is use of the salt having M1 which is the same as "M2" for the black ink.

The inventors of the present invention have found, after having studied the effect of adding a salt to the ink containing self-dispersing carbon black, that the ink shows notably improved stability when M2 (counter ion) of the hydrophilic group for the self-dispersing carbon black is the same as M1. Such an effect brought about by using M2 which is the same as M1 conceivably results from the prevented salt exchange between the counter ion in the hydrophilic group for the self-dispersing carbon black and salt to further improve dispersion stability of the self-dispersing carbon black, although this conception is not fully substantiated yet.

Use of ammonium or organic ammonium for M1 (and hence M2) brings about still improved resistance of the recorded image to water, in addition to the stabilized ink characteristics. In particular, Ph—COO($NH_4$) (ammonium benzoate) as a salt in the ink brings about an additional excellent effect of allowing the ink smoothly redischarged from the head nozzle after the ink jet recorder is out of service temporarily.

(Aqueous Medium for Black Ink)

The examples of the aqueous media for the black ink for the present invention include water and mixed solvents of water and water-soluble organic solvents. It is particularly preferable that the water-soluble organic solvent also works to prevent the ink from being dried.

The concrete examples of the water-soluble organic solvents useful for the present invention include alkyl alcohols of 1 to 4 Carbon atoms, e.g., methyl alcohol, ethyl alcohol, n-propyl alcohol, isopropyl alcohol, n-butyl alcohol, sec-butyl alcohol and tert-butyl alcohol; amides, e.g., dimethyl formamide and dimethyl acetamide; ketones and ketoalcohols, e.g., acetone and diacetone alcohol; ethers, e.g., tetrahydrofuran and dioxane; polyalkylene glycols, e.g., polyethylene glycol and polypropylene glycol; alkylene glycols having an alkylene group of 2 to 6 carbon atoms, e.g., ethylene glycol, propylene glycol, butylene glycol, triethylene glycol, 1,2,6-hexanetriol, thiodiglycol, hexylene glycol and diethylene glycol; lower alkyl ether acetate, e.g., polyethylene glycol monomethyl ether acetate; lower alkyl ethers of polyhydric alcohols, e.g., glycerin, ethylene glycol mono-methyl (or ethyl) ether, diethylene glycol mono-methyl (or ethyl) ether and triethylene glycol mono-methyl (or ethyl) ether; polyhydric alcohols, e.g., trimethylol propane and trimethylol ethane; and N-methyl-2-pyrrolidone, 2-pyrrolidone and 1,3-dimethyl-2-imidazolidinone. These water-soluble organic solvents may be used either individually or in combination. Water is preferably deionized.

The water-soluble organic solvent is incorporated in the black ink preferably at 3 to 50% by weight, based on the whole ink, although not limited thereto, and water is incorporated preferably at 50 to 95% by weight, also based on the whole ink.

The black ink described above brings about the excellent effect of greatly reducing dependence of printing quality on recording medium characteristics. Moreover, it has other advantages.

With respect to the above-described black ink and control which has the same composition as the black ink except that it is free of the salt, both ink eventually give the images of similar optical density, but the black ink (a) for the present invention gives the saturated density at a lower pigment concentration than the control black ink (b), by which is meant that incorporation of the salt can reduce the required concentration of the pigment in the ink without affecting optical density of the image.

More concretely, when ammonium benzoate as one example of the salt is incorporated at around 1% by weight, the black ink containing the self-dispersing carbon black at around 4% by weight gives the image having an optical density of around 1.4 on the common printing paper, the optical density showing essentially no increase even when the carbon black content is increased further. On the other hand, the salt-free black ink gives the image having an optical density of around 1.32 on the common printing paper at a carbon black content of 4% by weight, which is essentially a saturated level, because the density increases only to around 1.35 when the carbon black content is increased to 7% by weight, and even to 8% by weight.

The difference between these inks in the saturated optical density level is numerically minor at 0.05 (1.4 versus 1.35), but discernable to the naked eye when the printed images are compared with each other. Thus, the salt-containing ink brings about favorable effects of giving the printed image of higher optical density at a lower carbon black content and a higher saturated optical density level itself than the salt-free one. The black ink containing carbon black dispersed by the aid of a dispersant has produced the results similar to those with the self-dispersing carbon black, concretely described above.

The salt-containing ink brings about another merit: it has a wider carbon black content margin range for optical density of the printed images, as described above. This very effectively prevents visually observable difference in optical density from occurring between the first and last printed images with the ink from the ink tank which has been out of service while holding the ink for an extended period at the same stance, e.g., left for 6 months with its nozzles turning upward.

The above-described ink has another effect, in addition to those brought by incorporation of the salt, of good intermittent dischargeability, which is an evaluation if the ink can be normally discharged from the very beginning without needing preliminary discharge or removal of the ink remaining in the nozzle, after the nozzle is left out of service for a given time period.

The desirable aqueous medium composition which can keep the above-described ink characteristics preferably contains glycerin, trimethylol propane, thiodiglycol, ethylene glycol, diethylene glycol, isopropyl alcohol or acetylene alcohol.

(Color Inks)

Known dyes and pigments can be used as the colorants for the color inks for the present invention. The dyes may be acidic, direct or the like. Most of the anionic dyes, whether they are conventional or newly synthesized, can be used, so long as they have adequate hue and concentration. Moreover, they may be used in combination.

The concrete examples of the anionic dyes include:

(Yellow Colorants)

C.I. Direct Yellow 8, 11, 12, 27, 28, 33, 39, 44, 50, 58, 85, 86, 87, 88, 89, 98, 100, 110 and 132;

C.I. Acid Yellow 1, 3, 7, 11, 17, 23, 25, 29, 36, 38, 40, 42, 44, 76, 98 and 99;

C.I. Reactive Yellow 2, 3, 17, 25, 37 and 42; and

C.I. Food Yellow 3;

(Red Colorants)

C.I. Direct Red 2, 4, 9, 11, 20, 23, 24, 31, 39, 46, 62, 75, 79, 80, 83, 89, 95, 197, 201, 218, 220, 224, 225, 226, 227, 228, 229 and 230;

C.I. Acid Red 6, 8, 9, 13, 14, 18, 26, 27, 32, 35, 42, 51, 52, 80, 83, 87, 89, 92, 106, 114, 115, 133, 134, 145, 158, 198, 249, 265 and 289;

C.I. Reactive Red 7, 12, 13, 15, 17, 20, 23, 24, 31, 42, 45, 46 and 59; and

C.I. Food Red 87, 92 and 94;

(Blue Colorants)

C.I. Direct Blue 1, 15, 22, 25, 41, 76, 77, 80, 86, 90, 98, 106, 108, 120, 158, 163, 168, 199 and 226;

C.I. Acid Blue 1, 7, 9, 15, 22, 23, 25, 29, 40, 43, 59, 62, 74, 78, 80, 90, 100, 102, 104, 117, 127, 138, 158 and 161; and C.I. Reactive Blue 4, 5, 7, 13, 14, 15, 18, 19, 21, 26, 27, 29, 32, 38, 40, 44 and 100;

(Black Colorants)

C.I. Direct Black 17, 19, 22, 31, 32, 51, 62, 71, 74, 112, 113, 154, 168 and 195;

C.I. Acid Black 2, 48, 51, 52, 110, 115 and 156; and

C.I. Food Black 1 and 2.

(Solvent)

The examples of the solvents or dispersing media for the above-described color inks containing a colorant include water and mixed solvents of water and water-soluble organic solvents. The water-soluble organic solvents for the color inks are similar to those described above for the black ink. When the color ink is to be deposited on the recording medium by the ink jet method (e.g., bubble jet method), it is preferable that the ink is adjusted to have required viscosity and surface tension for the excellent ink jet discharging characteristics, as described earlier.

(Colorant Content)

Content of the colorant in the color ink for the present invention may be adequately set in such a way that the ink exhibits the excellent ink jet discharging characteristics and keeps the required hue and concentration for specific purposes, e.g., recording by the ink jet method. It is preferably in a range of 3 to 50% by weight, based on the whole ink, as one standard. The dye is incorporated in the color ink particularly preferably at 10% by weight or less, based on the whole color ink, for visual uniformity of the black image, as described earlier. Water is incorporated in the ink preferably at 50 to 95% by weight, based on the whole ink.

(Penetrability of Color Ink)

The above-described color ink having the Ka value of, e.g., 5 or more can produce high-quality color images on the recording medium, and hence is desirable. In other words, the ink having such a Ka value is highly penetrable into the recording medium, to prevent color bleeding even between adjacent color images of at least two colors, e.g., those selected from the group consisting of yellow, magenta and cyan colors. At the same time, each color ink is sufficiently penetrable to efficiently control bleeding even between the two-color images with an image of one ink being put on that of another ink. The color ink can be prepared to have the above Ka value by a known method, e.g., use of surfactant or penetrable solvent, e.g., glycol ether. It is needless to say that its addition rate should be adequately set.

The color ink for the present invention preferably contains an additive which can degrade dispersion stability of the black ink, when its dye is mixed therewith, as described earlier. The examples of the reactive component for the color ink to degrade dispersion stability of the pigment in the black ink include polyvalent metal salts, e.g., divalent or trivalent metal salts having a divalent or trivalent metal cation of $Mg^{2+}$, $Ca^{2+}$, $Cu^{2+}$, $Co^{2+}$, $Ni^{2+}$, $Fe^{2+}$, $La^{3+}$, $Nd^{3+}$, $Y^{3+}$ or $Al^{3+}$. The examples of the anion which can react with the above cation to form the salt include nitrate ion ($NO_3^-$) or acetate ion ($CH_3COO^-$).

These polyvalent metal salts may be used either individually or in combination of two salts. When two or more salts are used, at least one of the metal cations is supplied to the ink. The polyvalent metal salt is incorporated preferably at 0.1 to 15% by weight, based on the whole ink.

<Ink for Examination of Printed Conditions>

The ink for examination of printed conditions to be supplied into the ink flow path in the ink jet head, which is filled with the reactive ink while the head is in service for printing, is not limited, so long as it is free of any reactive component and satisfies the requirements for the examination. One example of the ink for examination is the reactive ink from which the reactive component is removed.

<Ink for Preservation>

The ink for preservation is not limited, so long as it contains neither colorant nor reactive component and satisfies the requirements for the preservation. It may be the same as or different from at least one of the ink for examination and that for preservation, except for the colorant and reactive component.

One of the preferable examples of the ink for preservation is the reactive ink from which the reactive component and colorant are removed. Its composition may be the same as or different from the reactive ink, except for the reactive component and colorant, as described earlier. The above ink composition for preservation is particularly suitable for the case where the recording ink set is a combination of the ink for preservation and reactive ink of different liquid medium, the latter containing a component reactive with the former.

However, as disclosed by Japanese Patent Application Laid-Open No. 2000-127442, the ink for preservation may be alkaline, in order to prevent contamination of the film over the recording head heater surface by the contaminants eluted out of the recording head component member while it is preserved for extended periods (including the delivery period). When it is to be alkaline, it may be kept at, e.g., pH 9 or more.

Consider an ink jet system comprising a set of the recording head H1001, shown in FIGS. 7A and 7B, filled with the ink for preservation combined with another independent recording head equipped with four ink tanks holding the recording inks, each for one of the reactive inks or the ink containing a colorant which loses dispersion stability of its colorant when mixed with each color ink. The user, on receiving the ink jet system, join the ink tanks in the recording head to form the recording head cartridge, and for example, sets the cartridge in the recording apparatus to start recording after replacing the ink for reservation in the recording head by the recording inks.

EXAMPLES

The present invention is described in detail by referring to Examples and the drawings, which by no means limit the present invention, and variations may be made by one skilled in the art without departing from the spirit and scope of the present invention. In Examples, part(s) and % are by weight, unless otherwise stated.

Examples 1 to 3 and Comparative Examples 1 to 3

(Preparation of the Ink for Examination and that for Recording)

The following components were mixed with each other and sufficiently agitated for each of the cyan, magenta and yellow inks, and the mixture was filtered under pressure by a microfilter (Fuji Film) having a pore size of 0.2 $\mu$m, to produce each color ink for recording.

<Cyan ink C1: C>

| | |
|---|---|
| Glycerin | 7.5 parts |
| 2-Pyrrolidone | 7.5 parts |
| Ethylene urea | 7.5 parts |
| Nonionic surfactant, Acetylenol EH (Kawaken Fine Chemicals) | 1 part |
| C.I. Direct Blue 199 | 3.5 parts |
| Ion-exchanged water | Balance |

-continued

| | |
|---|---|
| <Cyan ink 2: C2> | |
| Glycerin | 7.5 parts |
| 2-Pyrrolidone | 7.5 parts |
| Ethylene urea | 7.5 parts |
| Nonionic surfactant, Acetylenol EH (Kawaken Fine Chemicals) | 1 part |
| Magnesium nitrate | 1 part |
| C.I. Direct Blue 199 | 3.5 parts |
| Ion-exchanged water | Balance |
| <Cyan ink 3: C3> | |
| Glycerin | 7.5 parts |
| 2-Pyrrolidone | 7.5 parts |
| Ethylene urea | 7.5 parts |
| Nonionic surfactant, Acetylenol EH (Kawaken Fine Chemicals) | 1 part |
| Magnesium nitrate | 3 parts |
| C.I. Direct Blue 199 | 3.5 parts |
| Ion-exchanged water | Balance |
| <Magenta ink 1: M1> | |
| Glycerin | 7.5 parts |
| 2-Pyrrolidone | 7.5 parts |
| Trimethylol propane | 5 parts |
| Nonionic surf actant, Acetylenol EH (Kawaken Fine Chemicals) | 1 part |
| C.I. Acid Red 289 | 3.5 parts |
| Ion-exchanged water | Balance |
| <Magenta ink 2: M2> | |
| Glycerin | 7.5 parts |
| 2-Pyrrolidone | 7.5 parts |
| Ethylene urea | 7.5 parts |
| Nonionic surfactant, Acetylenol EH (Kawaken Fine Chemicals) | 1 part |
| C.I. Acid Red 289 | 3.5 parts |
| Ion-exchanged water | Balance |
| <Magenta ink 3: M3> | |
| Glycerin | 7.5 parts |
| 2-Pyrrolidone | 7.5 parts |
| Ethylene urea | 7.5 parts |
| Nonionic surfactant Acetylenol EH (Kawaken Fine Chemicals) | 1 part |
| Magnesium nitrate | 2 parts |
| C.I. Acid Red 289 | 3.5 parts |
| Ion-exchanged water | Balance |
| <Yellow ink 1: Y1> | |
| Glycerin | 7.5 parts |
| Ethylene glycol | 7.5 parts |
| Ethylene urea | 7.5 parts |
| Nonionic surfactant, Acetylenol EH (Kawaken Fine Chemicals) | 1 part |
| C.I. Direct Yellow 132 | 3 parts |
| Ion-exchanged water | Balance |
| <Yellow ink 2: Y2> | |
| Glycerin | 7.5 parts |
| 2-Pyrrolidone | 7.5 parts |
| Ethylene urea | 7.5 parts |
| Nonionic surfactant, Acetylenol EH (Kawaken Fine Chemicals) | 1 part |
| C.I. Direct Yellow 132 | 3 parts |
| Ion-exchanged water | Balance |
| <Yellow ink 3: Y3> | |
| Glycerin | 7.5 parts |
| 2-Pyrrolidone | 7.5 parts |
| Ethylene urea | 7.5 parts |
| Nonionic Surfactant, Acetylenol EH (Kawaken Fine Chemicals) | 1 part |
| Magnesium nitrate | 2 parts |
| C.I. Direct Yellow 132 | 3 parts |
| Ion-exchanged water | Balance |

<Black Ink>

For the black ink, the pigment dispersion was prepared by the following procedure:

A solution of 5 g of concentrated hydrochloric acid dissolved in 5.3 g of water was incorporated with 1.58 g of anthranilic acid at 5° C. It was stirred in an ice bath to be kept at 10° C. or lower, to which a solution of 1.78 g of sodium nitrite dissolved in 8.7 g of water, kept at 5° C., was added. It was further stirred for 15 minutes, to which 20 g of carbon black, having a specific surface area of 320 $m^2/g$ and DBP oil absorption of 120 ml/100 g, was added with stirring, and the mixture was further stirred for additional 15 minutes. The resultant slurry was filtered by a filter paper (Toyo Roshi No. 2, Advantis). The separated pigment particles were thoroughly washed with water and dried at 110° C. in an oven, to which water was added to prepare the 10% pigment dispersion. This introduced the group represented by the following chemical formula in the carbon black surface.

[Chemical Formula 3]

The following components were mixed and thoroughly stirred to prepare the solution, which was filtered under pressure by a microfilter (Fuji Film) having a pore size of 3 $\mu$m, to produce the black ink for recording.

| | |
|---|---|
| Glycerin | 5 parts |
| Trimethylol propane | 6 parts |
| Ethylene glycol | 5 parts |
| Potassium chloride | 0.5 parts |
| Nonionic surfactant, Acetylenol EH (Kawaken Fine Chemicals) | 0.15 parts |
| The above-described pigment dispersion | 30 parts |
| Ion-exchanged water | Balance |

(Preparation of Ink for Preservation)

The following components were mixed, thoroughly stirred, and filtered under pressure by a microfilter (Fuji Film) having a pore size of 0.2 $\mu$m, to produce the ink for preservation.

| | |
|---|---|
| <Ink for preservation 1: H1) | |
| Glycerin | 7.5 parts |
| 2-Pyrrolidone | 7.5 parts |
| Ethylene urea | 7.5 parts |
| Nonionic surfactant, Acetylenol (Kawaken Fine Chemicals) | 1 part |
| Ion-exchanged water | Balance |
| <Ink for preservation 2: H2) | |
| Glycerin | 7.5 parts |
| Ethylene glycol | 7.5 parts |
| Urea | 7.5 parts |
| Nonionic surfactant, Acetylenol (Kawaken Fine Chemicals) | 1 part |
| Sodium hydroxide | 0.7 parts |
| Ammonium sulfate | 2.5 parts |
| Ion-exchanged water | Balance |
| <Ink for preservation 3: H3> | |
| Glycerin | 7.5 parts |
| Ethylene glycol | 5 parts |
| Trimethylol propane | 5 parts |
| Nonionic surfactant, Acetylenol (Kawaken Fine Chemicals) | 1 part |
| Ion-exchanged water | Balance |
| <Ink for preservation 4: 84) | |
| Glycerin | 7.5 parts |
| Ethylene glycol | 7.5 parts |

-continued

| | |
|---|---|
| Nonionic surfactant, Acetylenol (Kawaken Fine Chemicals) | 1 part |
| Ion-exchanged water | Balance |

The ink sets, each composed of the inks for examination, preservation and recording, were prepared using the above-described inks in a combination as the following table.

| | | Ink for examination | Ink for preservation | Ink for recording |
|---|---|---|---|---|
| Example 1 | Bk | Bk1 | H4 | Bk1 |
| | C | C1 | H1 | C3 |
| | M | M1 | H1 | M1 |
| | Y | Y1 | H1 | Y1 |
| Example 2 | Bk | Bk1 | H4 | Bk1 |
| | C | C1 | H1 | C3 |
| | M | M2 | H1 | M3 |
| | Y | Y2 | H1 | Y3 |
| Example 3 | Bk | Bk1 | H4 | Bk1 |
| | C | C1 | H2 | C2 |
| | M | M1 | H2 | M1 |
| | Y | Y1 | H2 | Y1 |
| Comparative Example 1 | Bk | Bk1 | H4 | Bk1 |
| | C | C1 | H3 | C3 |
| | M | M1 | H3 | M1 |
| | Y | Y1 | H3 | Y1 |
| Comparative Example 2 | Bk | Bk1 | H4 | Bk1 |
| | C | C2 | H2 | C2 |
| | M | M1 | H2 | M1 |
| | Y | Y1 | H2 | Y1 |
| Comparative Example 3 | Bk | Bk1 | H4 | Bk1 |
| | C | C3 | H2 | C3 |
| | M | M3 | H2 | M3 |
| | Y | Y3 | H2 | Y3 |

Of the inks prepared in Example 1, only the cyan ink for recording contained magnesium nitrate as the component reactive with the pigment in the black ink, and the ink for preservation of the color inks compositionally corresponded to that for the cyan ink free of magnesium nitrate. Of the inks prepared in Example 2, all of the color inks of cyan, magenta and yellow contained magnesium nitrate as the component reactive with the pigment in the black ink, and the ink for preservation of the color inks compositionally corresponded to that for the cyan (magenta or yellow) ink free of magnesium nitrate. Of the inks prepared in Example 3, only the cyan ink for recording contained magnesium nitrate as the component reactive with the pigment in the black ink, and the ink for preservation of the color inks compositionally corresponded to that for the magenta ink.

Of the inks prepared in Comparative Example 1, only the cyan ink for recording contained magnesium nitrate as the component reactive with the pigment in the black ink, and the ink for preservation of the color inks compositionally corresponded to that for the magenta ink.

Of the inks prepared in Comparative Example 2, only the cyan ink for recording contained magnesium nitrate as the component reactive with the pigment in the black ink, and it was also used as the ink for examination. The ink for preserving the color inks prepared in this example was alkaline. Of the inks prepared in Comparative Example 3, all of the color inks of cyan, magenta and yellow contained magnesium nitrate as the component reactive with the pigment in the black ink, and it was also used as the ink for examination. The ink for preserving the color inks prepared in this example was alkaline.

H4 was used as the ink for preserving the black ink in all of Examples and Comparative Examples. However, the ink for preservation is not limited to H4, and the ink for preserving the color ink (H1, H2 or H3) may be used, as far as possible.

Each of Examples and Comparative Examples prepared the recording head of the structure shown in FIGS. 1A and 1B (the second cavitation-resistant film was of a 99% pure Ta film, and first cavitation-free film had a composition of $Ta\alpha Fe\beta Ni\gamma Cr\delta$ (wherein, $10\% \leqq \alpha \leqq 30\%$ , $\alpha+\beta<80\%$, $a<\beta$, $\delta>\gamma$, and $\alpha+\beta+\gamma+\delta=100\%$, all percentages being by atom), and printed images on common commercial paper with the ink for examination using the recording head. These images are regarded as the initial images. The ink for preservation prepared in each of Examples and Comparative Examples was charged and sealed in the recording head of the structure shown in FIGS. 1A and 1B. Each was stored for 1 month in a form of delivery, set in a recording apparatus of the structure shown in FIG. 9, and used to print images on common commercial paper, after the ink for preservation was replaced by the inks for recording full-color images by the suction recovery procedure taken after the recording head was received.

When the recording head was filled with the ink for preservation, the ink for examination was diluted with, and almost completely replaced by, the ink for preservation prepared by the above-described method, by repeating the suction recovery procedure 5 times using the liquid supply system described in the preferred embodiments, after the initial images were printed.

(Printing Results)

When the method described in each Example was followed (with the ink free of the reactive component for examination), the recording head produced the images which were as good as the initial images for all of the inks, after it was preserved for 1 month and the ink for preservation was replaced by the ink for recording.

When the method described in each Comparative Example was followed, on the other hand, the recording head produced the images comparing clearly unfavorable with the initial images, after it was preserved for 1 month and the ink for preservation was replaced by the ink for recording; for example, the cyan images were patchy in Comparative Examples 1 and 2, and the cyan, magenta and yellow images were patchy in Comparative Example 3.

The present invention can provide a method of preserving a recording head which uses a reactive ink for recording to keep its designated functions without deteriorating them. The present invention can also provide an ink jet system including a recording head and ink tank, removably attached thereto or detached therefrom, which are connected to each other when a reactive ink for recording is supplied into an ink flow path in the recording head for sustaining recording.

Use of the ink free of colorant and reactive component for preservation allows to commonize the ink for preservation to be supplied into each ink flow path in the recording head, even when the ink set for recording contains at least one pair of the reactive ink and another ink reactive with the reactive component in the reactive ink, the liquid media therefor being compositionally different from each other. This, in turn, allows common induction replaceability of the ink for preservation in each recording head or each chip having two or more recording heads on the same board while the ink for preservation is supplied into each ink flow path, e.g., for replacing the ink for examination, improving efficiency of the replacement procedure. Commonizing the ink for preservation for each recording head or each chip having two or more recording heads on the same board dispenses with considerations for matching the recording ink set which comprises the ink for preservation, reactive inks different from each other in the components for the liquid media and ink free of the reactive component.

What is claimed is:

1. A method of preserving a recording head which includes an ink flow path by which the ink is supplied and a discharge port in communication with the ink flow path to discharge the ink supplied into the ink flow path; is connected to an ink tank in the recording apparatus in such a way to be removably attached to or detached from the ink tank, to allow the ink to be discharged from the discharge port; and uses a reactive ink as the recording ink containing a colorant and reactive component reactive with another ink, comprising a step of examining discharging conditions of the recording head using an ink for examination of a composition free of the reactive component, which is supplied into the ink flow path, and a step of preserving the recording head for preservation by replacing the ink for examination remaining in the ink flow path in the recording head by an ink for preservation containing neither the colorant nor reactive component, after the step of examining discharging conditions is over.

2. The method of preserving a recording head according to claim 1, wherein said recording head can work for recording by replacing said ink for preservation by the ink containing a color ink for recording.

3. The method of preserving a recording head according to claim 1, wherein said recording head is structured with a base comprising a board which supports a heat-generating resistor forming the heat-generating section, electrode wiring electrically connected to the heat-generating resistor and cavitation-resistant film provided on the heat-generating resistor and electrode wiring via an insulating/protective layer, and said ink flow path is structured to correspond to the heat-generating section, said cavitation-resistant film having a Ta or TaAl film at least in the portion which comes into contact with the ink.

4. The method of preserving a recording head according to claim 1, wherein said recording head includes two or more independent ink flow paths, and said reactive ink is supplied into at least one of the ink flow paths.

5. The method of preserving a recording head according to claim 1, wherein said cavitation-resistant film has a Ta-containing amorphous alloy film as the layer below said Ta or TaAl film.

6. The method of preserving a recording head according to claim 1, wherein said ink flow path includes a bubble-generating region, and movable member facing the bubble-generating region and displaced as the bubbles grow.

7. The method of preserving a recording head according to claim 6, wherein said ink flow path includes a restriction member responsible for restricting displacement of said movable member following growth of the bubbles, and is substantially disconnected in the direction of ink flow when the movable member displaced as the bubbles grow substantially comes into contact with the restriction member.

8. The method of preserving a recording head according to claim 6, wherein said the free end of said movable member is disposed at almost the center of said bubble-generating region.

9. The method of preserving a recording head according to claim 1, wherein said ink for preservation is alkaline.

10. An ink jet system including a recording head for ink jet and an ink tank for holding the ink, wherein said ink tank has a section which holds reactive ink for recording, the reaction ink containing a colorant and a reactive component which is reactive with another ink, said recording head includes an ink flow path removably attached to or detached from the ink tank and supplied with the ink when attached to the tank, and a discharge port in communication with the ink flow path for discharging the ink supplied into the ink flow path, the said ink flow path being filled with ink for preservation containing neither colorant nor reactive component which is to be replaced by the reactive ink for recording, and said recording head is structured with a base comprising a board which supports a heat-generating resistor forming a heat-generating section, electrode wiring electrically connected to the heat-generating resistor, and cavitation-resistant film provided on the heat-generating resistor and electrode wiring via an insulating/protective layer, said cavitation-resistant film having a Ta or TaAl film at least in the portion which comes into contact with the ink;

wherein said cavitation-resistant film has a Ta-containing amorphous alloy film as a layer below said Ta or TaAl film.

11. The ink jet system according to claim 10, said recording head has the ink flow path filled with said ink for preservation replacing ink for examination, after said recording head is examined for printed conditions, with the ink for examination having the same composition as said reactive ink from which the reactive component is removed.

12. An ink jet system including a recording head for ink jet and an ink tank for holding the ink, wherein said ink tank has a section which holds reactive ink for recording, the reaction ink containing a colorant and a reactive component which is reactive with another ink, said recording head includes an ink flow path removably attached to or detached from the ink tank and supplied with the ink when attached to the tank, and a discharge port in communication with the ink flow path for discharging the ink supplied into the ink flow path, the said ink flow path being filled with ink for preservation containing neither colorant nor reactive component which is to be replaced by the reactive ink for recording, and said recording head is structured with a base comprising a board which supports a heat-generating resistor forming a heat-generating section, electrode wiring electrically connected to the heat-generating resistor, and cavitation-resistant film provided on the heat-generating resistor and electrode wiring via an insulating/protective layer, said cavitation-resistant film having a Ta or TaAl film at least in the portion which comes into contact with the ink;

wherein said ink flow path includes a bubble-generating region, and a movable member facing the bubble-generating region and displaced as the bubbles grow.

13. The ink jet system according to claim 12, wherein said recording head includes two or more ink flow paths and said ink tank includes two or more ink holding sections, each corresponding to each of the ink flow paths, at least one of the ink holding sections being filled with said reactive ink.

14. The ink jet system according to claim 12, wherein said ink flow path includes a restriction member responsible for restricting displacement of said movable member following growth of the bubbles, and is substantially disconnected in the direction of ink flow when the movable member displaced as the bubbles grow substantially comes into contact with the restriction member.

15. The ink jet system according to claim 12, wherein the free end of said movable member is disposed substantially at the center of said bubble-generating region.

16. The ink jet system according to claim 12, wherein said ink for preservation is alkaline.

17. An ink set having an ink for recording containing at least one type of reactive ink, wherein said ink for recording has at least one combination of a non-reactive ink containing a colorant in a liquid medium and reactive ink containing a reactive component reactive with another ink and colorant in a liquid medium compositionally different from that for the non-reactive ink, and said ink set is further provided with the ink for preserving the reactive and non-reactive inks, which is the reactive ink from which the colorant and reactive component are removed.

18. The ink set according to claim 17 constituting said ink for recording, containing a black ink and one or more color inks, the black ink containing a pigment dispersed in the aqueous medium by the actions of the aqueous medium and ionic group, wherein at least one of the one or more color inks contains a reactive ink which can degrade dispersion stability of the pigment in the black ink.

19. The ink set according to claim 17, which contains at least cyan, magenta and yellow inks as the color inks.

20. The ink set according to claim 17, wherein said reactive component is a polyvalent metal salt.

21. The ink set according to claim 20, wherein said polyvalent metal salt is selected from the group consisting of $Mg^{2+}$, $Ca^{2-}$, $Cu^{2+}$, $Co^{2+}$, $Ni^{2+}$, $Fe^{2+}$, $La^{3+}$, $Nd^{3+}$, $Y^{3+}$ and $Al^{3+}$.

22. The ink set according to claim 20, wherein said polyvalent metal salt is incorporated at 0.1 to 15% by weight, based on the whole ink.

23. A method of preserving a recording head for ink jet which includes an ink flow path by which the ink is supplied and a discharge port in communication with the ink flow path to discharge the ink supplied into the ink flow path; is connected to an ink tank in the recording apparatus in such a way to be removably attached to or detached from the ink tank; and uses a recording ink having at least one combination of a non-reactive ink containing a colorant in a liquid medium and reactive ink containing a reactive component reactive with another ink and colorant in a liquid medium compositionally different from that for the non-reactive ink, comprising a step of filling the ink flow path in the recording head with the ink for preservation, composed of the reactive ink from which the colorant and reactive component are removed, to make the recording head for preservation.

24. The method of preserving a recording head according to claim 23, wherein said recording head can work for recording by replacing said ink for preservation by the ink containing a color ink fox recording.

25. The method of preserving a recording head according to claim 23, wherein said recording head is structured with a base comprising a board which supports a heat-generating resistor forming the heat-generating section, electrode wiring electrically connected to the heat-generating resistor and cavitation-resistant film provided on the heat-generating resistor and electrode wiring via an insulating/protective layer, and said ink flow path is structured to correspond to the heat-generating section.

26. The method of preserving a recording head according to claim 25, wherein said cavitation-resistant film has a Ta-containing amorphous alloy film as the layer below said Ta or TaAl film.

27. The method of preserving a recording head according to claim 23, wherein said recording head includes two or more independent ink flow paths, and said reactive ink is supplied into at least one of the ink flow paths.

28. The method of preserving a recording head according to claim 23, wherein the ink set constituting said ink for recording contains a black ink and one or more color inks, the black ink containing a pigment dispersed in the aqueous medium by the actions of the aqueous medium and ionic group, and at least one of the one or more color inks containing a reactive ink which can degrade dispersion stability of the pigment in the black ink.

29. The method of preserving a recording head according to claim 23, wherein said color inks include at least cyan, magenta and yellow inks.

30. The method of preserving a recording head according to claim 23, wherein said reactive component is a polyvalent metal salt.

31. The method of preserving a recording head according to claim 30, wherein said polyvalent metal salt is one selected from the group consisting of $Mg^{2+}$, $Ca^{2+}$, $Cu^{2+}$, $Co^{2+}$, $Ni^{2+}$, $Fe^{2+}$, $La^{3+}$, $Nd^{3+}$, $Y_{3+}$ and $Al^{3+}$.

32. The method of preserving a recording head according to claim 30, wherein said polyvalent metal salt is incorporated at 0.1 to 15% by weight, based on the whole ink.

* * * * *

UNITED STATES PATENT AND TRADEMARK OFFICE

CERTIFICATE OF CORRECTION

PATENT NO. : 6,688,730 B2
DATED : February 10, 2004
INVENTOR(S) : Noriyasu Asaki et al.

It is certified that error appears in the above-identified patent and that said Letters Patent is hereby corrected as shown below:

Title page,
Item [57], ABSTRACT,
Line 13, "step of step of" should read -- step of --.

Column 3,
Line 9, "Ink" should read -- ink --; and
Line 39, "have" should read -- has --.

Column 4,
Line 47, "a" should be deleted.

Column 7,
Line 12, "Te-containing" should read -- Ta-containing --.

Column 9,
Line 45, "layer generates" should read -- layer which generates --.

Column 10,
Line 49, "form" should read -- from --.

Column 11,
Line 3, "act" should read -- acts --; and
Line 56, "present" should read -- presents --.

Column 13,
Line 16, "component" should read -- components --; and
Line 32, "$Y^{3-}$" should read -- $Y^{3+}$ --.

Column 14,
Line 54, "$COH_3$ –$N(CH_3)_3$" should read -- $COH_2$ –$N(CH_3)_3$ --; and
Line 67, "$NO_3\cdot$" should read -- $NO_3^-$ --.

Column 15,
Line 20, "surfacer" should read -- surface, --.

Column 16,
Line 26, "Nar" should read -- Na, --.

UNITED STATES PATENT AND TRADEMARK OFFICE

CERTIFICATE OF CORRECTION

PATENT NO. : 6,688,730 B2
DATED : February 10, 2004
INVENTOR(S) : Noriyasu Asaki et al.

It is certified that error appears in the above-identified patent and that said Letters Patent is hereby corrected as shown below:

Column 17,
Line 11, “ink smoothly” should read -- ink to be smoothly --; and
Line 53, “ink” should read -- inks --.

Column 20,
Line 34, “join” should read -- joins --;
Line 37, “reservation” should read -- preservation --; and
Line 59, “<Cyan ink C1: C)” should read -- <Cyan ink 1: C1> --.

Column 22,
Line 64, “<Ink for preservation 4: 84>“ should read -- <Ink for preservation 4: H4> --.

Column 25,
Line 65, “said the” should read -- the --.

Column 26,
Line 29, “claim 10,” should read -- claim 10, wherein --.

Column 27,
Line 38, “$Ca^{2-}$,” should read -- $Ca^{2+}$, --.

Column 28,
Line 10, “fox” should read -- for --; and
Line 45, “$Y_{3+}$” should read -- $Y^{3+}$ --.

Signed and Sealed this

Twelfth Day of October, 2004

JON W. DUDAS
*Director of the United States Patent and Trademark Office*